US010232209B2

(12) United States Patent
Pouchet

(10) Patent No.: US 10,232,209 B2
(45) Date of Patent: Mar. 19, 2019

(54) POSTURAL DYNAMICS EXERCISE SYSTEM

(71) Applicant: Gregory Kelvin Pouchet, Monterey, CA (US)

(72) Inventor: Gregory Kelvin Pouchet, Monterey, CA (US)

( * ) Notice: Subject to any disclaimer, the term of this patent is extended or adjusted under 35 U.S.C. 154(b) by 0 days.

(21) Appl. No.: 15/501,971

(22) PCT Filed: Aug. 10, 2015

(86) PCT No.: PCT/US2015/044493
§ 371 (c)(1),
(2) Date: Feb. 6, 2017

(87) PCT Pub. No.: WO2016/023030
PCT Pub. Date: Feb. 11, 2016

(65) Prior Publication Data

US 2017/0232289 A1 Aug. 17, 2017

Related U.S. Application Data

(60) Provisional application No. 62/034,783, filed on Aug. 8, 2014.

(51) Int. Cl.
*A63B 21/06* (2006.01)
*A63B 7/00* (2006.01)
(Continued)

(52) U.S. Cl.
CPC ..... *A63B 7/00* (2013.01); *A63B 5/11* (2013.01); *A63B 21/005* (2013.01);
(Continued)

(58) Field of Classification Search
CPC ..... A63B 7/00; A63B 22/02; A63B 21/4043; A63B 21/0552; A63B 23/03541;
(Continued)

(56) References Cited

U.S. PATENT DOCUMENTS 339,650 A * 4/1886 Hill ..... A63B 69/0064 482/69
1,432,013 A * 10/1922 Blake ..... A63B 21/0004 482/124
(Continued)

FOREIGN PATENT DOCUMENTS

DE 2433202 A1 2/1975
ES 2151390 A1 6/2001
(Continued)

*Primary Examiner* — Garrett K Atkinson
(74) *Attorney, Agent, or Firm* — Shay Glenn LLP

(57) ABSTRACT

Exercise apparatuses that may be particularly useful or treating and strengthening connective tissue. For example, apparatuses that may have or be reconfigured to have multiple (e.g., three or more) configurations that are suspended from above by a ceiling or stand. The equipment facilitates the stabilization of the body according to the principle of tensegrity, so that the tension in all movements is omni-directionally coherent, thus creating omni-tensional integrity, which may be helpful in treatment and strengthening of muscular connective tissue (fasciae) in musculoskeletal dynamics, to restore, rebuild, strengthen and regain elasticity within the human fascial network. These apparatuses can support the user at an oblique body angle while the user performs various movements.

19 Claims, 45 Drawing Sheets

(51) Int. Cl.

| | |
|---|---|
| ***A63B 71/06*** | (2006.01) |
| ***A63B 5/11*** | (2006.01) |
| ***A63B 21/005*** | (2006.01) |
| ***A63B 21/008*** | (2006.01) |
| ***A63B 21/02*** | (2006.01) |
| ***A63B 21/04*** | (2006.01) |
| ***A63B 21/055*** | (2006.01) |
| ***A63B 21/068*** | (2006.01) |
| ***A63B 21/00*** | (2006.01) |
| ***A63B 21/28*** | (2006.01) |
| ***A63B 22/02*** | (2006.01) |
| ***A63B 23/02*** | (2006.01) |
| ***A63B 23/035*** | (2006.01) |
| ***A63B 23/04*** | (2006.01) |
| ***A63B 23/12*** | (2006.01) |
| ***A63B 21/16*** | (2006.01) |
| ***A63B 69/00*** | (2006.01) |
| *A63B 22/00* | (2006.01) |

(52) U.S. Cl.

CPC ..... *A63B 21/008* (2013.01); *A63B 21/00069* (2013.01); *A63B 21/0088* (2013.01); *A63B 21/00181* (2013.01); *A63B 21/023* (2013.01); *A63B 21/0442* (2013.01); *A63B 21/0552* (2013.01); *A63B 21/06* (2013.01); *A63B 21/0603* (2013.01); *A63B 21/068* (2013.01); *A63B 21/151* (2013.01); *A63B 21/16* (2013.01); *A63B 21/169* (2015.10); *A63B 21/285* (2013.01); *A63B 21/4007* (2015.10); *A63B 21/4009* (2015.10); *A63B 21/4011* (2015.10); *A63B 21/4015* (2015.10); *A63B 21/4034* (2015.10); *A63B 21/4035* (2015.10); *A63B 21/4043* (2015.10); *A63B 22/02* (2013.01); *A63B 23/0238* (2013.01); *A63B 23/03533* (2013.01); *A63B 23/03541* (2013.01); *A63B 23/03575* (2013.01); *A63B 23/0405* (2013.01); *A63B 23/1209* (2013.01); *A63B 69/0057* (2013.01); *A63B 71/0622* (2013.01); *A63B 69/0059* (2013.01); *A63B 2022/0094* (2013.01); *A63B 2208/0204* (2013.01); *A63B 2208/0209* (2013.01); *A63B 2208/029* (2013.01); *A63B 2208/0214* (2013.01); *A63B 2208/0223* (2013.01); *A63B 2208/0228* (2013.01); *A63B 2209/10* (2013.01); *A63B 2220/50* (2013.01); *A63B 2225/09* (2013.01); *A63B 2225/093* (2013.01)

(58) Field of Classification Search

CPC ..... A63B 21/008; A63B 21/4007; A63B 23/03575; A63B 21/4015; A63B 23/1209; A63B 21/16; A63B 21/023; A63B 5/11; A63B 71/0622; A63B 21/4035; A63B 21/169; A63B 21/0088; A63B 21/005; A63B 21/0442; A63B 21/00181; A63B 69/0057

See application file for complete search history.

(56) References Cited

U.S. PATENT DOCUMENTS 1,703,375 A * 2/1929 Volk ..... A63B 69/0059 473/216
1,734,238 A * 11/1929 Sweeney ..... A63B 21/0004 482/123
1,867,642 A * 7/1932 Woods ..... A63B 21/04 482/125
2,812,010 A * 11/1957 Abdallah ..... A61H 3/008 482/69
2,959,414 A * 11/1960 Saltz ..... A63B 21/04 242/379.2
3,083,037 A * 3/1963 Gordon ..... A63B 19/04 280/206
3,701,529 A * 10/1972 Kruthaupt ..... A63B 5/00 482/123
3,804,420 A * 4/1974 Boyd ..... A63B 69/0059 273/DIG. 21
3,995,853 A * 12/1976 Deluty ..... A63B 21/015 482/116
4,114,873 A * 9/1978 Jones ..... A63B 69/0022 482/139
4,135,714 A * 1/1979 Hughes ..... A63B 21/04 473/229
4,174,832 A * 11/1979 Thompson ..... A63B 21/018 482/120
4,195,834 A * 4/1980 Lambert, Jr. ..... A63B 21/06 482/101
4,328,965 A * 5/1982 Hatfield ..... A63B 21/025 124/23.1
4,431,184 A 2/1984 Lew et al.
4,944,511 A * 7/1990 Francis ..... A63B 21/02 482/116
4,961,573 A * 10/1990 Wehrell ..... A63B 21/0552 482/124
4,976,623 A * 12/1990 Owsley ..... A63B 69/0064 434/247
5,033,460 A * 7/1991 Goldish ..... A61H 1/0218 606/241
5,090,694 A * 2/1992 Pauls ..... A63B 21/015 482/118
5,147,265 A * 9/1992 Pauls ..... A63B 21/015 482/115
5,158,510 A * 10/1992 Lemire ..... A63B 21/4001 482/51
5,358,461 A * 10/1994 Bailey, Jr. ..... A63B 21/0053 290/1 R
5,382,212 A * 1/1995 Davenport ..... A63B 21/04 482/121
D359,324 S * 6/1995 Phegley ..... D21/662
5,486,149 A * 1/1996 Smith ..... A63B 21/015 482/120
5,509,873 A * 4/1996 Corn ..... A63B 21/153 482/124
5,618,249 A * 4/1997 Marshall ..... A63B 21/153 482/115
5,626,540 A * 5/1997 Hall ..... A61H 1/0229 482/69
5,667,461 A * 9/1997 Hall ..... A61H 1/0229 472/15
5,669,858 A * 9/1997 Blair ..... A63B 5/11 280/204
D399,272 S * 10/1998 Zwonitzer ..... D21/683
5,941,807 A * 8/1999 Cassidy ..... A63B 22/14 482/130
6,099,447 A * 8/2000 Ramsaroop ..... A63B 21/153 482/107
6,120,422 A * 9/2000 Kiemer ..... A63B 21/015 482/114
6,224,514 B1 * 5/2001 Price ..... A63B 21/055 242/470
6,436,006 B1 * 8/2002 Zemlyakov ..... A63B 21/0083 482/112
D487,123 S * 2/2004 Ihli ..... D21/662
6,689,075 B2 * 2/2004 West ..... A61F 5/0102 482/69
6,890,288 B2 * 5/2005 Bingham ..... A47D 13/046 482/69
7,131,936 B2 * 11/2006 Schlosser ..... A61H 3/008 482/69
7,255,666 B2 8/2007 Cardenas
7,338,418 B2 * 3/2008 Erez ..... A63B 69/0059 119/770

(56) References Cited

U.S. PATENT DOCUMENTS

| | | | | |
|---|---|---|---|---|
| 7,462,141 | B1 * | 12/2008 | Raboin | A63B 21/225 482/110 |
| 7,637,853 | B2 * | 12/2009 | Crowson | A63B 21/00 482/127 |
| 7,666,126 | B2 * | 2/2010 | Rempe | A63B 22/18 482/121 |
| 7,780,587 | B2 * | 8/2010 | Thornton | A61H 3/008 119/770 |
| 8,075,453 | B1 * | 12/2011 | Wilkinson | A63B 22/0005 482/51 |
| 8,323,127 | B2 * | 12/2012 | Webb | A63B 69/0002 473/422 |
| 8,465,401 | B1 * | 6/2013 | Ihli | A63B 21/00185 482/116 |
| 8,556,785 | B1 * | 10/2013 | Ihli | A63B 21/015 482/116 |
| 2005/0209069 | A1 | 9/2005 | Biernacki | |
| 2006/0035770 | A1 * | 2/2006 | Crowson | A63B 21/00 482/129 |
| 2007/0015641 | A1 * | 1/2007 | Demeniuk | A63B 21/0004 482/124 |
| 2010/0130338 | A1 * | 5/2010 | Wehrell | A61H 1/0229 482/124 |

FOREIGN PATENT DOCUMENTS

| | | | |
|---|---|---|---|
| FR | 1321733 | A | 3/1963 |
| WO | WO2011/089632 | A1 | 7/2011 |

* cited by examiner

POSTURAL DYNAMICS EXERCISE SYSTEM

CROSS REFERENCE TO RELATED APPLICATIONS

This application claims the benefit under 35 U.S.C. 119 of U.S. Patent Application No. 62/034,783, filed Aug. 8, 2014, titled "POSTURAL DYNAMICS EXERCISE SYSTEM". This application is herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Embodiments of the invention relate generally to exercise equipment, and more specifically to exercise equipment that can strengthen, rebuild, and/or restore a user's connective tissues.

BACKGROUND

The designed equipment finds the application within the field of physical rehabilitation, injury prevention and performance enhancement. Based on the latest scientific findings regarding the role of muscular connective tissues (fasciae) in musculoskeletal dynamics, training fascia is the missing crucial element to the already existing muscular strength work, cardiovascular training and sensory motor refinement coordination commonly used for physical therapy treatment and performance.

A special approach is typically needed to engage the fascial net. Collagen architecture responds to loading. Appropriate tissue stimulation is necessary to alter collagen architecture (e.g., collagen remodeling). For example, shear, gliding and tensioning motion is needed to therapeutically affect the flexible and resilient collagenous matrix in superficial fascial membranes, as well as a dynamic muscular loading pattern in which the muscle is both activated and extended, for comprehensive stimulation of fascial tissue. Unfortunately, most prior art exercise and mobility equipment is ill suited to treating and strengthening fascia. The apparatuses (e.g., exercise equipment) described herein may address these needs and allow for the effective treatment to restore, rebuild and strengthen connective tissues, and establish myofascial connectedness over as many joints as possible. In particular, the apparatuses described herein may permit a user and/or therapist to focus on moving the body as a functional whole by applying tensional forces that are evenly distributed throughout the body, avoiding overloading of the tissue, and particularly the fascia, instead of focusing on moving muscles in isolation.

SUMMARY OF THE DISCLOSURE

Described herein is exercise equipment that facilitates the engagement of those structures necessary to improve function of the connective tissue, musculoskeletal system and nervous system to facilitate the body's inherent self-healing capacities. These apparatuses may include systems, devices or a combination of different devices or a single device with multiple configurations. Any of these apparatuses may include a support for supporting and applying (or allowing a user to apply) balanced, smooth and controlled forces that may be most effective at treating fascia. These apparatuses may include a harness, backrest and neck support (and any additional accessories) in conjunction with vertical, lateral and front stabilizers, to allow movement execution in oblique angles (within 360 degrees) creating the necessary shear forces to restore, rebuild and strengthen the entire fascial network.

Moving in the apparatuses described herein, with and without the support of ones' bodyweight and the applied tensional forces may allow for oblique loaded movement execution to address connective tissue, minimize or reduce stress on all of the joints and create an ideal force transmission from the feet into the spine. This may engage the axial skeleton as a 'prime mover/power' in all of our motion, as well as creating a sense of a midline, or axis, from where the axial skeleton engages with the appendicular skeleton in a double direction. Once the appendicular skeleton is in support to/of the axial skeleton, the axial skeleton can then generate 'axial power'.

The postural dynamics exercise system (PDES) model enhances spinal function through movement as well as improving and reorganizing the various systems of the human body (fascia, musculoskeletal, nervous system, vestibular system and sensory awareness) by incorporating force/counterforce, inertia and rotation through oblique angles. This exercise apparatuses described herein may provide a practical and accessible approach to personal fitness and physical therapy.

For example, described herein are exercise systems for restoring, rebuilding, and/or strengthening a person's neuromyofascial web (including connective tissue) by supporting the person (e.g., in an angled position, relative to the ground). A system may include: an anchor configured to stabilize the system relative to an environmental surface; a first support bar hanging from the anchor at a coupling site and configured to rotate in a first plane relative to the anchor, the first support bar comprising a pair of arms extending out of the first plane and away from the anchor; wherein each arm includes a lateral attachment site near a distal end region of each arm configured to couple with one or more elastic straps, further wherein the first support bar is adjustable to separately adjust: a distance between the lateral attachment sites in a second plane parallel to the first plane, and a distance between the lateral attachment sites and the environmental surface in a third plane perpendicular to the first plane; a second support bar hanging from the anchor so that the first support bar is between the second support bar and the anchor, wherein the second support bar is configured to rotate in a fourth plane parallel to the first plane; and at least two medial attachment sites on the second support bar that are spaced apart from each other and configured to couple with one or more elastic straps.

Any of the systems described herein may also include a plurality of elastic straps configured to attach to the lateral and medial attachment sites. In general, the elastic straps may be elastic bands, ropes, cords, springs, cables, or the like. The elastic straps are generally elongate, and may have any appropriate cross-sectional shape and area. Thus, the elastic straps may be of different "strengths" based on how elastic they are. The elastic straps may be of any appropriate length, and may include one or more attachment sites, e.g., the proximal and distal ends. The elastic straps may also be adjustable (e.g., in length, tension, etc.), e.g., including a buckle or other length-adjusting element.

The anchor may be one of: a stand, a cantilever stand, a cantilever wall mount, or a ceiling mount. For example, the anchor may be configured to extend from a wall, ceiling, or the like, as illustrated herein.

The first support bar may be referred to herein as "bar 2" in reference to the figures. The anchor may be referred to in some of the figures as "bar 1" and the second support bar may be referred to herein as "bar 3".

The arms of the first support bar may each comprise a first straight region extending in a horizontal direction and a second straight region extending in a vertical direction. Alternatively or additionally, the arms may be curved or bending. The arms may be adjustable by telescoping (e.g., to lengthen/shorten) and/or by hinges or adjustment of the angle of the arms. The arms of the first support bar may each comprise a first straight region extending in a horizontal direction and a second straight region extending in a vertical direction, wherein the length of the first straight region is adjustable and the length of the second straight region is adjustable.

Any of the variations described herein may further include a lock having a control, wherein the lock is configured to releasably prevent the first support bar from rotating in the first plane. For example, any of the systems described herein may also include a lock, wherein the lock is configured to be independently locked into fixed positions in predetermined rotational increments between about 15 and 45 degrees.

The lateral and medial attachment sites may be one or more of loops, rings, hoops, holes or channels that are configured to couple with an elastic strap. The attachment sites may be rotatable, as illustrated, and/or lockable (e.g., to prevent rotation) or they may be permanently fixed. For example, the medial attachment sites on the second support structure are rotatable relative to the second support bar.

The spacing between the medial attachment sites on the second support bar may be adjustable.

Any of the variations of the systems described herein may also include a bent, curved or bent and curved elongate member configured to attach between the arms of the first support bar in a plane. For example, the system may also include a bent, curved or bent and curved elongate member configured to be removably attached between the arms of the first support bar, the elongate member having an attachment configured to be removably attached to an elastic strap. In some variations, the system includes a bent, curved or bent and curved elongate member configured to attach between the arms of the first support bar in a plane, wherein the elongate member forms a half circle, a full circle, a triangle, a half diamond, or a full diamond.

Any of the systems described herein may include a harness. The harness is generally configured to be worn by the person using the device, and may include one or more attachments for the straps. In general, the harness may include at least one central loop or attachment region, such as a ring, that may be positioned near the chest when worn, e.g., just below or at the person's sternum.

For example, a harness may include one or more (or all) of: a pair of adjustable leg loops configured to be secured to the person's thighs; an adjustable chest strap configured to be secured around the person's chest at the level of the person's nipples; a first pair of attachments disposed on a first lateral side of the adjustable chest strap, wherein the first pair of attachments are each configured to be removably attached to an elastic member; a second pair of attachments disposed on a second lateral side of the adjustable chest strap such that the first pair of attachments and the second pair of attachments are located on opposite lateral sides of the person's chest when the harness is worn by the person, wherein the second pair of attachments are each configured to be removably attached to an elastic member; and a frontal attachment between the adjustable chest strap and the pair of adjustable leg loops; and a backrest configured to provide support to the person's back when wearing the harness.

Any of these exercise systems may be configured so that the first support bar and the second support bar have a first configuration allowing free rotation, a second configuration allowing free rotation of the first support bar but preventing the second support bar from rotating, a third configuration allowing free rotation of the second support bar but preventing the first support bar from rotating, and a fourth configuration in which the first and second support bars are prevented from rotating. For example, a system may include one or more rotation bearings at the coupling site configured to hang the first support bar and the second support bar from the anchor, wherein the second support bar is attached to the anchor through the first support bar and the first and second support bars share a common axis of rotation through the one or more rotation bearings.

In any of these device variations having arms, the pair of arms of the first support bar may be removable.

Any of these apparatuses may also be configured to receive additional weights (e.g., from a typical gym weight, e.g., 5 pounds, 10 pounds, 25 pounds, 35 pounds, 45 pounds, etc.), and may include an attachment site, e.g., on each of the arms of the pair of arms of the first support bar configured to secure a gym weight.

Any of these systems may also include a pair of stirrups, wherein each stirrup comprises a foot support and two elastic straps that removably join the foot support to a harness, wherein the two elastic straps of each stirrup comprises an inner elastic strap configured to be positioned along the inner portion of a person's leg, and an outer elastic strap configured to be positioned along the outer portion of the person's leg.

The equipment may generally be adjustable. For example, the height of the arms and the spacing of the arms may be adjustable. The distance between the lateral attachment sites and the environmental surface may be adjustable, e.g., between about 3 feet to 6 feet. The distance between the first support structure and the anchor may be adjustable. For example, the distance between the lateral attachment sites may be adjustable between about 7 feet to 11 feet. The second support bar may have a width that is at least about 35 inches, and the spacing between the medial attachments may be adjustable between about 24 inches to 30 inches.

For example, described herein are exercise systems for restoring, rebuilding, and/or strengthening a person's neuromyofascial web by supporting the person (e.g., in an angled position), the system comprising: an anchor configured to stabilize the system relative to an environmental surface; a first support bar hanging from the anchor at a coupling site and configured to rotate in a first plane relative to the anchor, the first support bar comprising a pair of arms extending out of the first plane and away from the anchor, wherein each arm includes a lateral attachment site near a distal end region of each arm configured to couple with one or more elastic straps, further wherein the first support bar is adjustable to separately adjust: a distance between the lateral attachment sites in a second plane parallel to the first plane, and a distance between the lateral attachment sites and the environmental surface in a third plane perpendicular to the first plane; a second support bar hanging from the anchor so that the first support bar is between the second support bar and the anchor, wherein the second support bar is configured to rotate in a fourth plane parallel to the first plane; at least two medial attachment sites on the second support bar that are spaced apart from each other and configured to couple with one or more elastic straps; a harness including a backrest and configured to connect to the at least two medial attachment sites via one or more elastic straps.

In some variations, the exercise systems described for restoring, rebuilding, and/or strengthening a person's neuromyofascial web (including connective tissue) may include: an anchor; a first support structure comprising: a pair of arms that extend in both a horizontal and vertical direction, and one or more attachment features disposed on a vertically oriented portion of each arm; a second support structure that extends in a horizontal direction, the second support structure having at least two attachment features spaced apart from each other; a first rotatable element configured to be rotatably secured to both the anchor and the first support structure such that the first support structure can rotate relative to the anchor; a second rotatable element configured to be rotatably secured to both the first support structure and the second support structure such that the first support structure can rotate relative to the second support structure; a plurality of elastic members configured to be removably attached to the attachment features on the first support structure and the second support structure.

As mentioned above, any of these exercise systems may include a harness. The harness may comprise: a pair of adjustable leg loops configured to be secured to the person's thighs; an adjustable chest strap configured to be secured around the person's chest at the level of the person's nipples; a first pair of attachment features disposed on a first lateral side of the adjustable chest strap, wherein the first pair of attachment features are configured to be removably attached to the plurality of elastic members; a second pair of attachment features disposed on a second lateral side of the adjustable chest strap such that the first pair of attachment features and the second pair of attachment features are configured to be located on opposite lateral sides of the person chest when the harness is worn by the person, wherein the second pair of attachment features are configured to be removably attached to the plurality of elastic members; and a frontal attachment feature located between the adjustable chest strap and the pair of adjustable leg loops; and a backrest comprising a support structure configured to provide support to the person's back.

Any of these exercise systems may include a third support structure configured to be removably attached to the pair of arms of the first support structure, the third support structure having an attachment feature configured to be removably attached to one of the plurality of the elastic members. The third support structure (which may also be referred to as a bent, curved or bent and curved elongate member) may have a shape selected from the group consisting of a half circle, a full circle, a triangle, a half diamond, and a full diamond. The third support structure may be configured to be removably attached to the pair of arms of the first support structure such that the third support structure lies in a plane that is transverse to a plane that encompasses the first support structure.

The first support structure may have an adjustable width and an adjustable height. The vertical portion of each arm of the first support structure may be removable.

The first rotatable element and the second rotatable element may both have a first configuration which is configured to allow free rotation and a second configuration which allows the rotatable elements to be independently locked into a fixed position in predetermined increments. The predetermined increment is about 30 degrees. The first rotatable element and the second rotatable element may be configured to be secured to the anchor, the first support structure, and the second support structure such that the first rotatable element and the second rotatable element both rotate around a common axis.

As mentioned above, the pair of arms of the first support structure may be removable. The at least two attachment features on the second support structure may be rotatable. The at least two attachment features on the second support structure may be separated by a width that is adjustable. For example, the spacing of the attachments for attaching to elastic bands may be adjusted by releasing a lock on the attachment, sliding it along the bar, and locking it in a new position. The bar may have predefined positions (e.g., indents, coupling sites, etc.) where the attachments may be locked in place.

Any of these exercise systems may include a plurality of weights configured to be attached to the first support structure and/or the second support structure; and/or a neck support. The exercise system may include a pair of stirrups, wherein each stirrup comprises a foot support and two elastic members that removably join the foot support to the harness, wherein the two elastic members of each stirrup comprises an inner elastic member configured to be positioned along the inner portion of the person's leg, and an outer elastic member configured to be positioned along the outer portion of the person's leg. Any of these exercise system may include a sit bones support that can be removably inserted into the harness to provide support and proprioceptive feedback to the person so that the person can position the sit bones horizontally.

Each pair of arms of the first support structure may include a horizontal bar and a vertical bar having a free end, wherein the attachment features of the first support structure are disposed proximate the free end of the vertical bar. The pair of arms of the first support structure may have a vertical height that is adjustable between about 3 feet to 6 feet. The first support structure may have a vertical height that is adjustable between about 7 feet to 10 feet. The first support structure may have a width that is adjustable between about 7 feet to 11 feet.

The second support structure may have a width that is at least about 35 inches, and the attachment features of the second support structure are adjustably spaced apart from about 24 inches to 30 inches. When the harness is worn, the frontal attachment feature may be configured to be positioned between the person's umbilicus and sternum.

Also described herein are methods of using any of the devices described herein. For example, a method of restoring, rebuilding, and/or strengthening a person's neuromyofascial web (including connective tissue) by supporting the person (e.g., in an angled position relative to the ground) may include: holding the person within a harness and backrest that supports the person's torso while providing support to the person's back; suspending the harness from a second support bar via one or more elastic straps, wherein the second support bar is rotatable connected to a first support bar that is also rotatably connected between the second support bar and an anchor, further wherein the first support bar is rotatable relative to the anchor in a first plane and the second support bar is rotatable in a second plane parallel to the first plane; attaching one or more elastic straps to a pair of arms extending from the first support bar on either side of the person; adjusting the height and width of the pair of arms relative to the person's body; and allowing the user to move while connected to the first and second support bars via the elastic straps. In general the neuromyofascial web (or net) includes and may the connective tissue (fascia) and neural connections, blood vessels, muscles (e.g., the connection to the muscle), and in particular the connective tissue surrounding an wrapping these (e.g., extracellular matrix). In general, the neuromyofascial web may regulate the body, and organize the space within the body.

The method may also include supporting the person at an angle of between about 25 and 60 degrees relative to a ground surface.

Attaching the one or more elastic straps to the pair of arms may comprise attaching the one or more elastic straps to the harness. For example, attaching the one or more elastic straps to the pair of arms may comprise instructing the person to hold the one or more elastic straps.

The method may also include placing the person's feet in a pair of stirrups attached to the harness.

Holding the person within the harness may comprise supporting the person's neck. Holding the person within the harness may comprise adjusting a pair of leg loops to secure to the person's thighs and/or adjusting a chest strap around the person's chest at the level of the person's nipples.

Suspending the harness may comprise suspending the harness from a first pair of elastic bands connected to a first lateral side of the adjustable chest strap and a second pair of elastic bands connected to a second lateral side of the adjustable chest strap such that the first pair of elastic bands and the second pair of elastic bands are located on opposite lateral sides of the person chest.

The method may also include attaching a bent, curved or bent and curved elongate member between the pair of arms of the first support bar so that the elongate member extends around the person, and/or coupling an elastic band to the elongate member.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
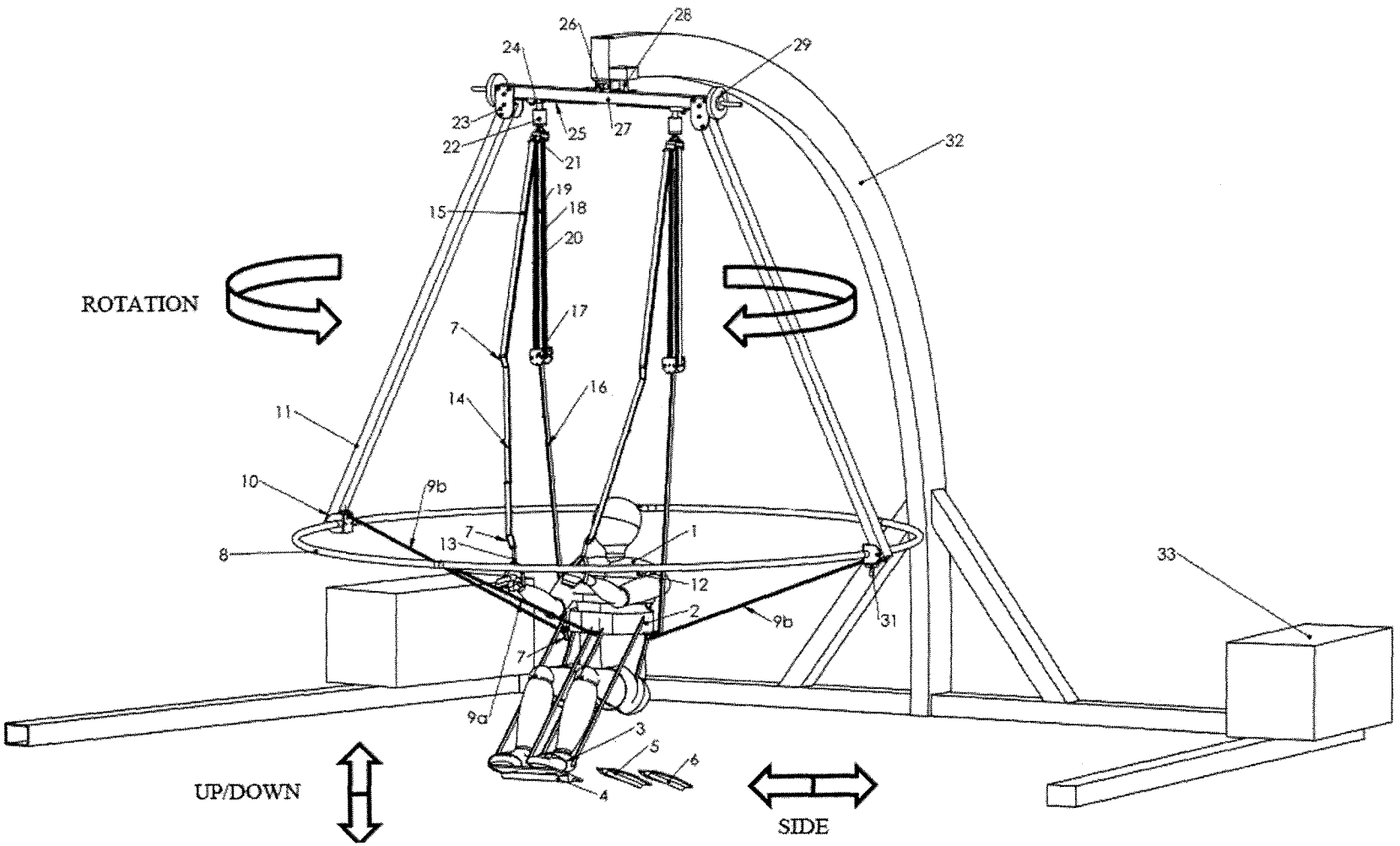
FIG. 1 is a perspective view that shows all of the components for a first variation of a Postural Exercise System device, referred to herein as device 1, with a stand.
Figure 2:
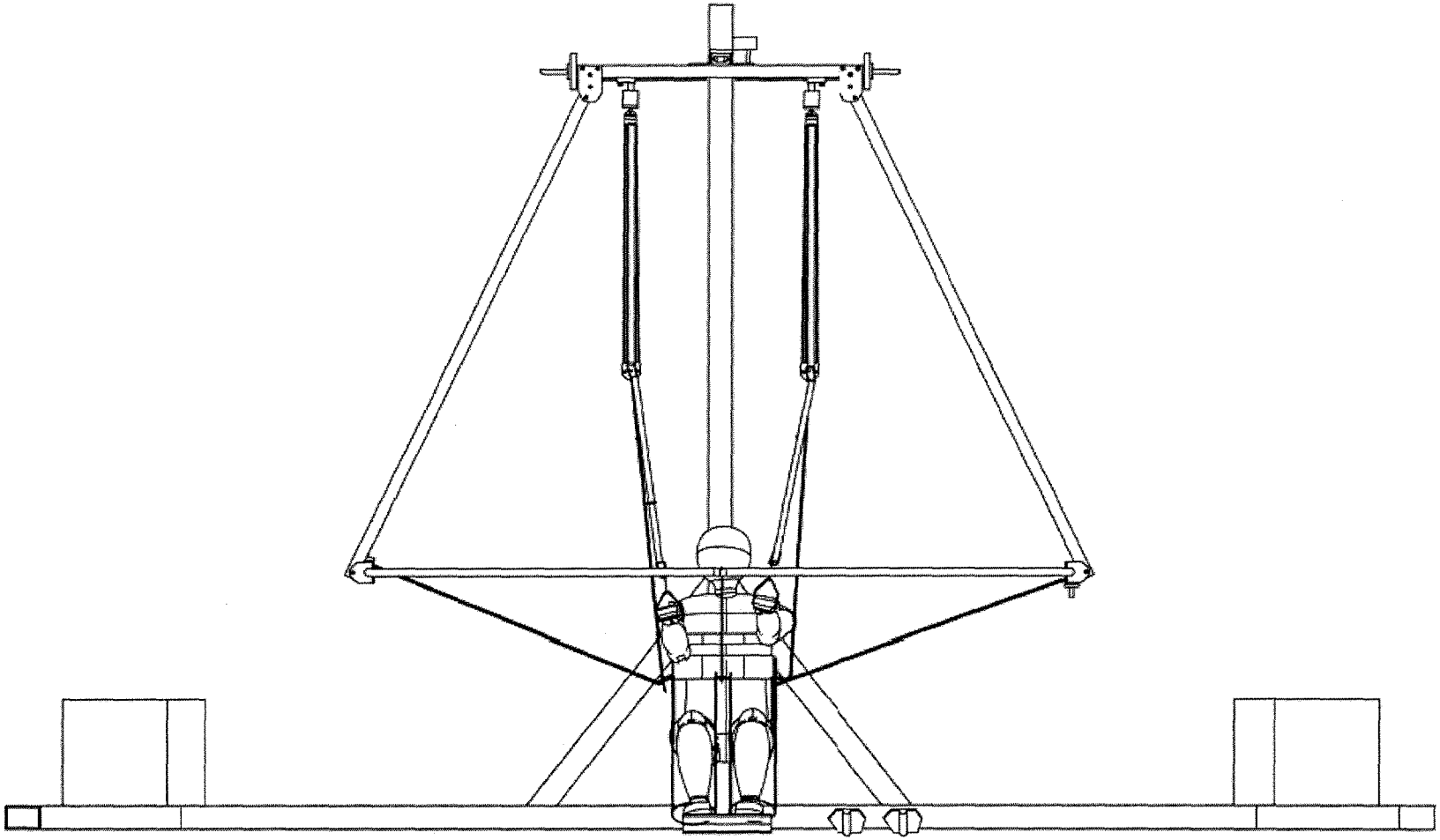
FIG. 2 is a front view of device 1 with a stand.
Figure 3:
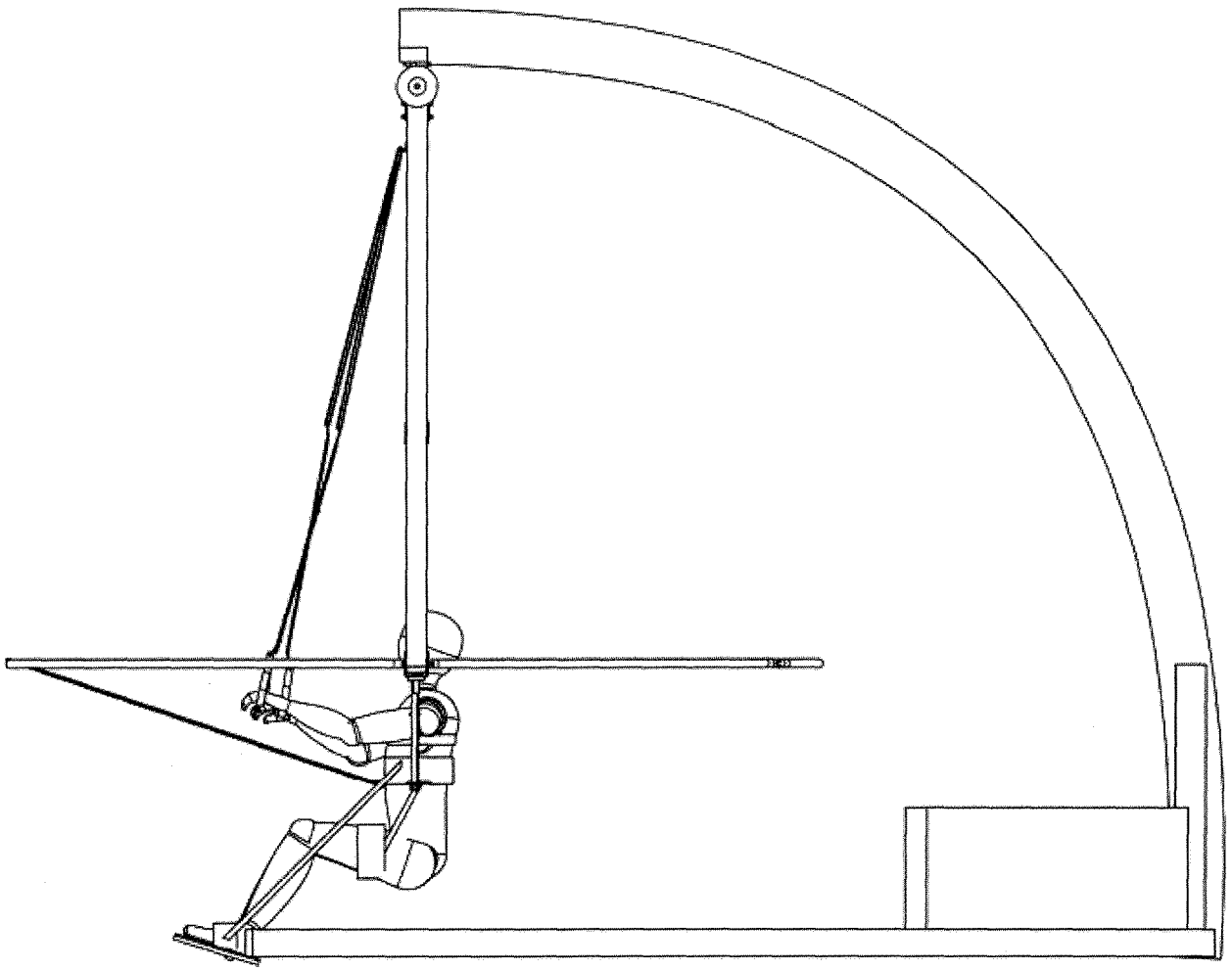
FIG. 3 is a side view of device 1 with a stand.

In general, the apparatuses described herein (devices, systems, assemblies, etc.) are configured to be used by a person to restore, rebuild and/or strengthen a person's connective tissue. These apparatuses may be configured to provide axial support through multiple, independently rotatable and lockable beams positionable above the person, from which one or more elastic straps (and in some variations arms or other support equipment) may extend for attaching or grasping by the person using the system.

For example, FIGS. 1-6 show various views of an embodiment of a postural dynamics exercise system, referred herein as device 1. This system can be used with a stand 32 or the device can be suspended from an existing ceiling that has adequate height. The person 1 is suspended in harness 2 connected with carbineer's 7 via an adjustable strap 16 that is attached to elastic bands 18, 19, 20 through an adjustable load interface bracket 17 which attaches to the top brackets 21 and 22 which allow rotation about the z axis. Depending on the person 1's weight the appropriate combination of bands 18 and 20 can be disconnected and connected via pins in adjustable load interface bracket 17 to give the correct tension. For example, the bands can be adjusted to provide about 140 pounds of tension per 60 kilograms of bodyweight. The shoulder width of the top bracket (attachments) 21, 22 can move in and out via slide 24 on a T rail 25, and the top brackets can rotate. The person's hands grip the two handles 13 attached to adjustable straps 14 via carbineer's 7 and then attached to elastic bands 15 which are attached to rotational brackets 21 and 22 at the top.

Figure 6:
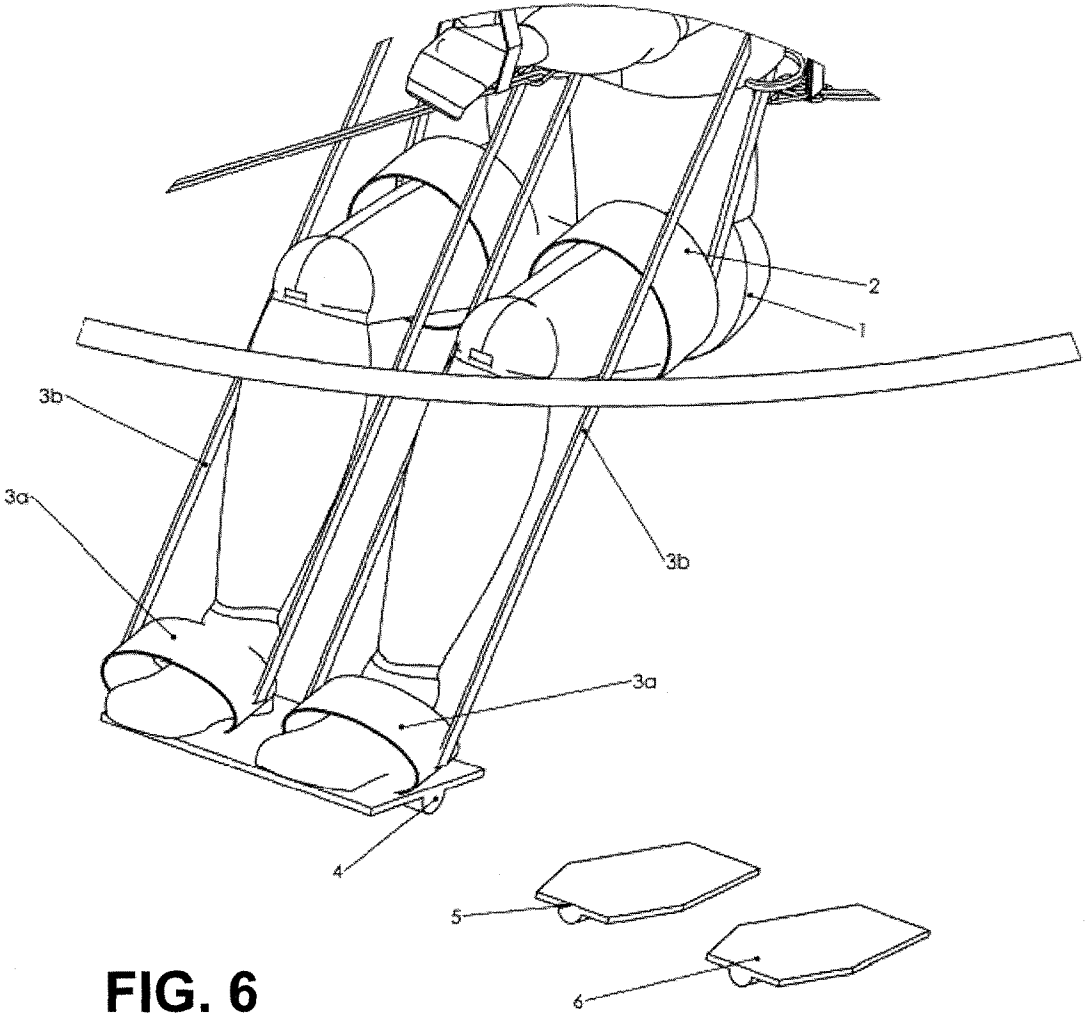
FIG. 6 shows detail of Foot/leg elastics (3*a* and 3*b*) of the variations of device 1 shown in FIG. 1.

The person 1 can be restrained by three lateral elastic chords 9*a* (front) and 9*b* (two lateral side) attached to ring 8 on one side and the person harness on the other side via a carbineer 7. As shown, the person 1 has two leg elastic restraints straps 3 to provide tensional feedback on the legs. FIG. 6 shows the person 1's feet are held in an ends open elliptical sock 3*a* that has two elastic chords 3*b* attached, inner and outer that also attach to the harness 2. Chords for lateral and leg tension come in three different load ratings to accommodate different size person 1. Around the person upper torso is a shoulder band 12 which stabilizes the upper torso during movement.

The person's feet can be placed on top of one of two types of footpads. Footpad 4 is used for both feet and rotates about the round half bar mounted horizontally on the bottom that is adjustable in position along the person's foot. The second uses two independent foot pads 5 and 6 which have half round bars mounted on angles on the bottom. In some embodiments, the footpads may have a strap or other retaining feature for securing the person's foot to the footpad. In some embodiments, the footpads may be secured in place on the ground. In some embodiments, the sole of the footpad may be made of a material, such as rubber, that provides traction to reduce slippage.

Figure 5:
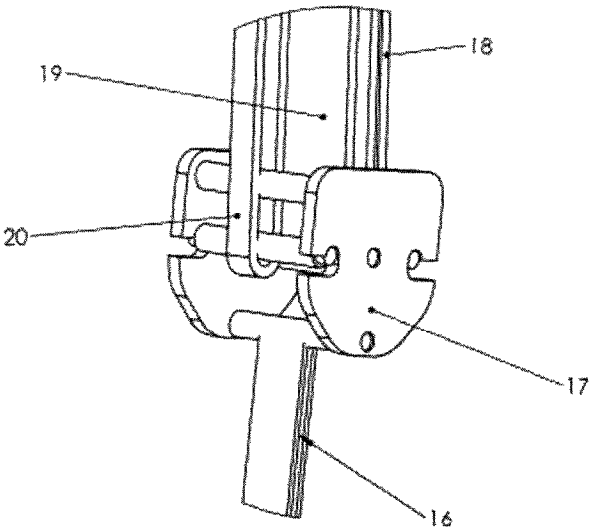
FIG. 5 is a close up perspective view of an adjustable weight elastic system bracket for device 1.
Figure 4:
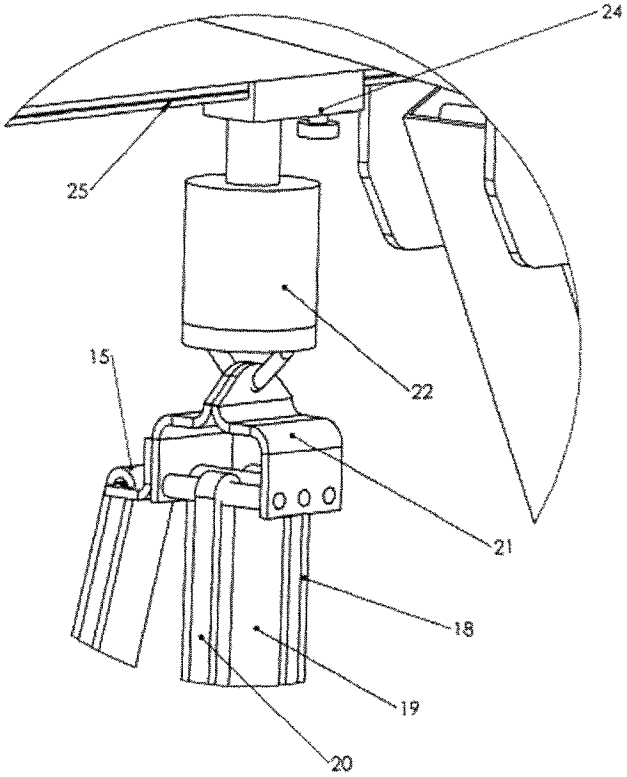
FIG. 4 is a close up perspective view of a top rotational support beam of device 1.

The ring 8 bottom brackets 10 are attached via struts 11 to the top support beam 27 via brackets 23. FIG. 5 shows the ring assembly can rotate when the lock pin 28 is released and then rotates about the top bearing 26. On the top support beam there are two mounts with adjustable weight pole 29. On the bottom of bracket 10 there is a weight adjustment mount 31 with weight.

The free stand 32 holds up the assembly and is held down in place by two large 100-150 gallon water containers 30 mounted on each side of the stand. Other weights, such as metal or sand weights, can also be used. In some embodiments, the stand can be fastened to the floor using bolts, for example.

The person performs a series of motions in different configurations of elastic band attachments. Person performs the following general motion:

Ring Closed No Rotation—ring 8 in closed position, pin lock 28 is engaged.

up and down (z axis),
front and back (y axis)
side to side (x axis).
Device 1 person configurations are as follows:
With or without Leg Straps 3.
With or without shoulder band 12.
With or without differing strength front stabilizer elastics 8.
With or without differing strength side stabilizer elastics 9*a*, and 9*b*.
Handle 13 and foot-leg loop attachment variations.

Ring Open Free to Rotate—ring 8 is open, pin lock 28 is disengaged.

Person performs rotational motion executed in oblique angles.
Device 1 person configurations are as follows:
With or without Leg Straps 3.
With or without shoulder band 12.
With or without differing strength front stabilizer elastics 8.
With differing strength side stabilizer elastics 9*a*, and 9*b*.
Handle 13 and foot-leg loop attachment variations.

No Ring (without front and lateral bands 8, 9*a*, and 9*b*) No rotation—pin lock 28 is engaged.

up and down (z axis),
front and back (y axis)
side to side (x axis).
Device 1 person configurations are as follows:
With or without Leg Straps 3.
With or without shoulder band 12.
Handle 13 and foot-leg loop attachment variations.

No Ring (without front and lateral bands 8, 9*a*, and 9*b*) Open rotation—pin lock 28 is disengaged.

Person performs rotational motion executed in oblique angles.
Device 1 person configurations are as follows:
With or without Leg Straps 3.
With or without shoulder band 12.
Handle 13 and foot-leg loop attachment variations.

Device 1 structure can be made of various metals such as steel, aluminum and/or composites. The elastics bands are rubber based and can be made of various rubber or urethane compounds. In some embodiments, the system may incorporate the use of air, hydraulic, springs, or electromagnet that can engage the bearings, rails, and/or struts to create a force that can provide additional resistance to the system. In addition, LED lights or markings mounted on the edge of the ring can provide a reference point view, and LED lights or a force meter can indicate a force level a person is exerting on the system.

Figure 7:
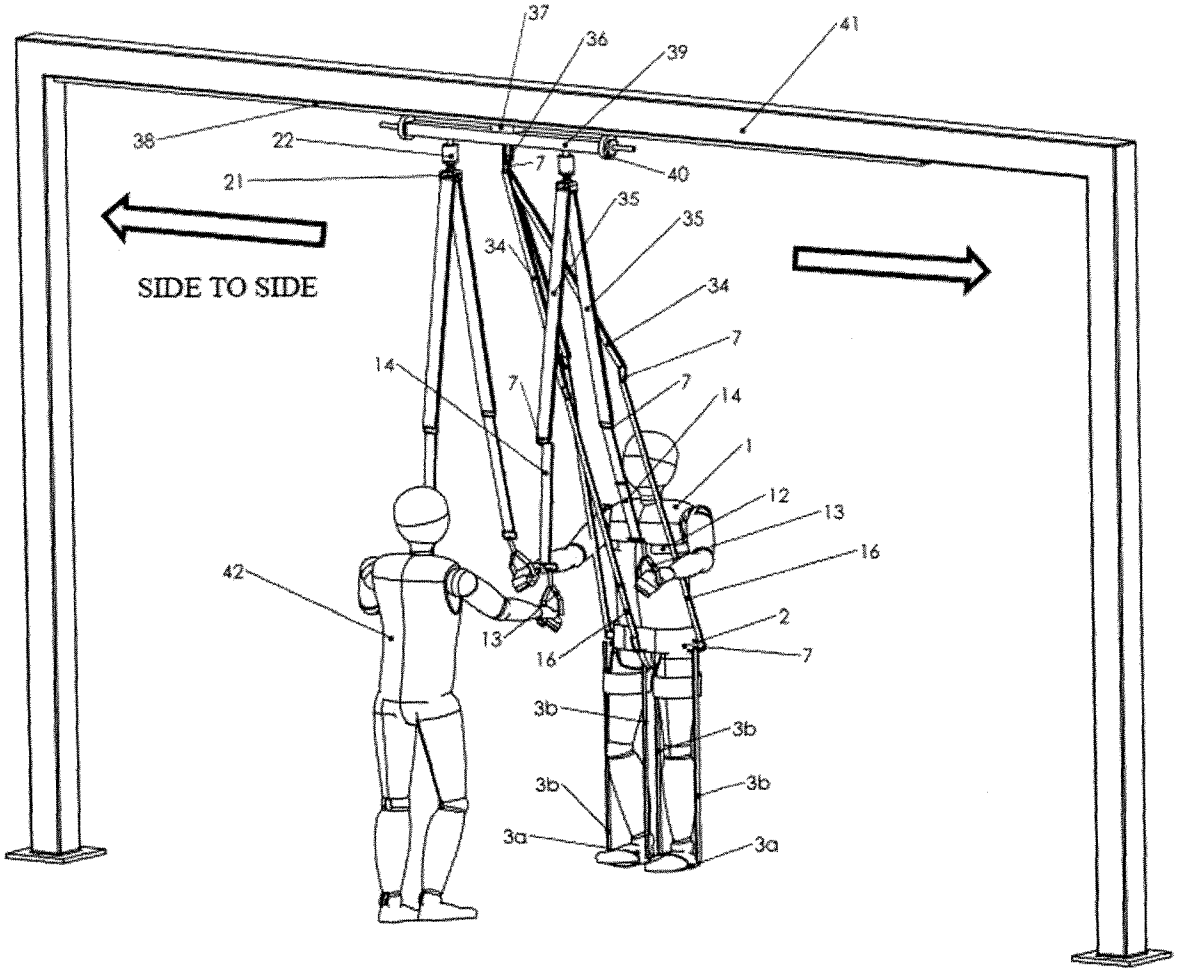
FIG. 7 is a perspective view of a second variation, referred to herein as device 2 with a stand.
Figure 8:
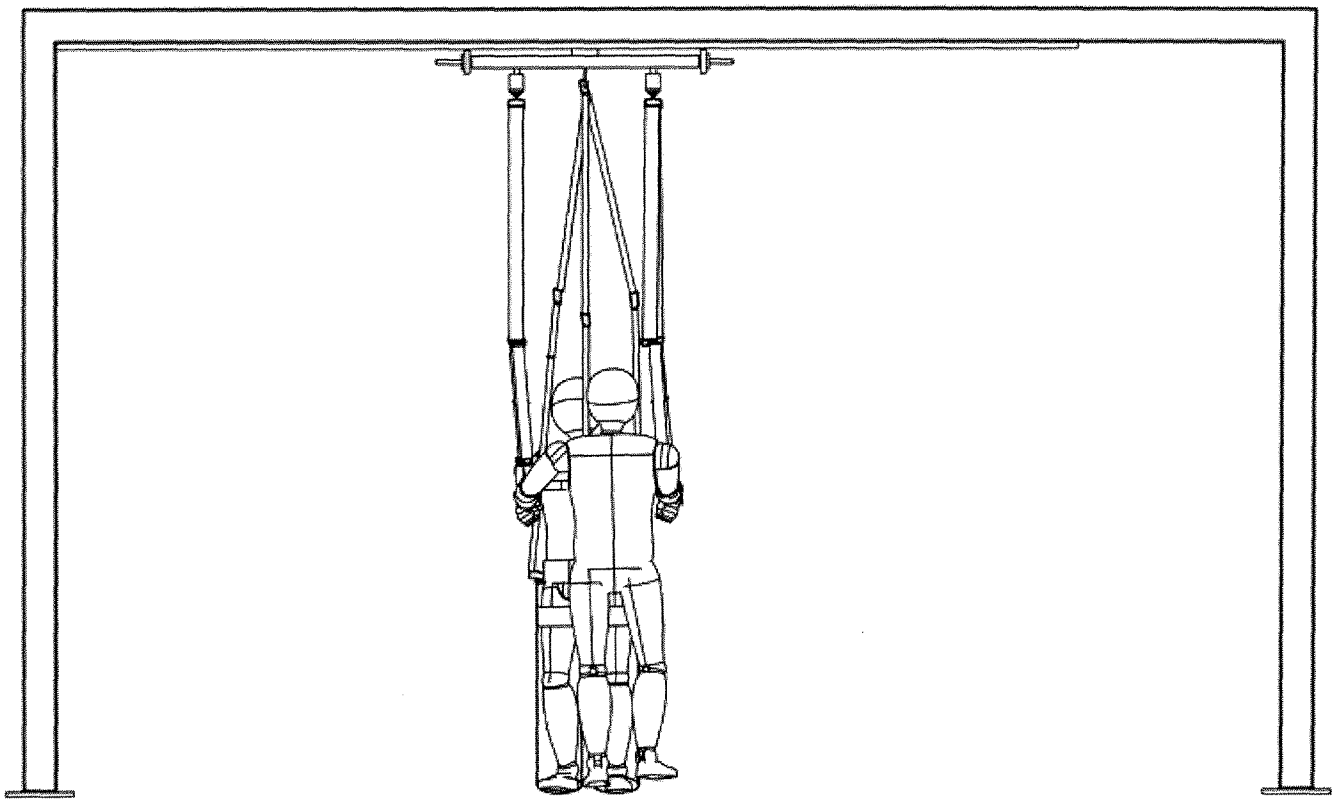
FIG. 8 is a front view of device 2 (FIG. 7) with a stand.
Figure 9:
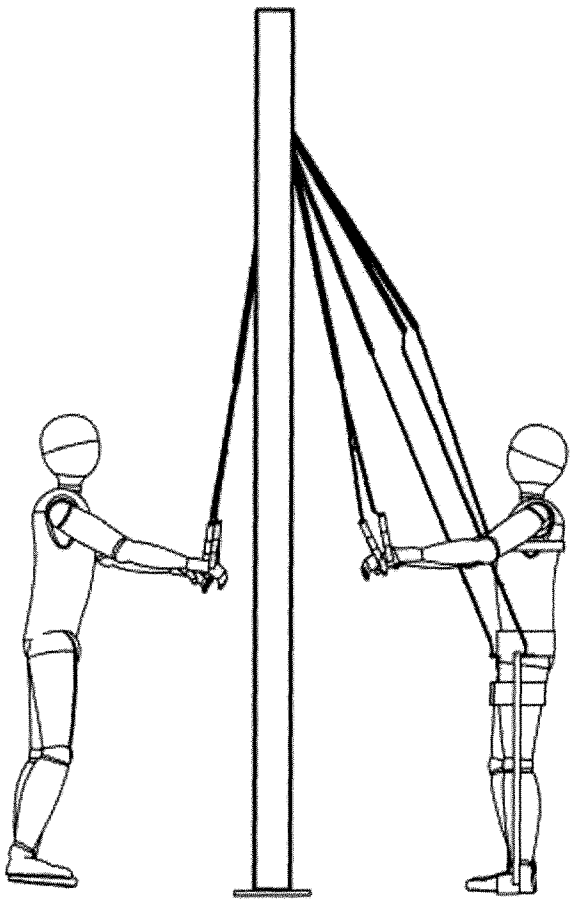
FIG. 9 is a side view of device 2 with a stand.

FIGS. 7-9 show various views of another embodiment of a postural dynamics exercise system, which will be referred herein as Device 2. In this system the person swings an adjustable weighted slide from one side to the other via elastic bands attached to handles. The slide is attached to a metal stand bolted to the floor. The person can also be slightly suspended in harness attached to the slide. Another configuration includes a trainer using independent handles and elastic bands but attached to the same mount on the slide.

This system has a stand 41 that is bolted via standard concrete bolts to the floor. Device 2 has several configurations of attachments and with and without a trainer 42. The person 1 is slightly suspended in harness 2 connected with carbineer's 7 via elastic bands 34 through a carbineer 7 connector to top bracket 21 and 22 which allows rotation about the z axis. The adjustable strap 16 allows height adjustment that is driven by the person's size. Optionally, in some variations, the person 1's hands grip the two handles 13 attached to adjustable straps 14 via carbineer's 7 and then attached to elastic bands 35 which are attached to rotational brackets 21 and 22 at the top. As described in greater detail below, in any of the device variations, a back support (back rest) may be used.

The person 1 has two leg elastic restraints straps 3 to provide tensional feedback on the legs. The person's feet are held in an ends open elliptical sock 3*a* that has two elastic chords 3*b*, inner and outer that attach to the harness 2.

Around the person upper torso is a shoulder band 12 which stabilizes the upper torso during movement.

On the top support beam there are two mounts with adjustable weight pole 40 and the slide 37 has adjustable friction level for added resistance.

Device 2 structures can be made of various metals such as steel, aluminum and/or composites. The elastic bands are rubber based and can be made of various rubber compounds. As described above, in some embodiments, the system may incorporate the use of air, hydraulic, spring, or electromagnet to create a force or resistance to the system or resistance from the slide, LED lights mounted on the slide for reference point view, LED lights or meter to indicate force level person is exerting on system.

The movements of the Device 2 are as follows:

Side to side motion of slide 37 and weight 40 is loading the different fascial components by engaging long myofascial chains and whole movements executed in oblique angles via elastics bands with varying attachments. In general, the apparatuses described herein allow the engagement of very long myofascial chains, because they may engage many of the interconnected muscular and skeletal systems (e.g., axial skeleton and appendicular skeleton).

Movement is executed by a person with or without trainer simultaneous on the opposite side as shown in FIGS. 7-9.

Attachment configurations:

With/without harness 2

With/without leg straps 3

With/Without shoulder band 12

With/without three center elastics 34 attached to harness 2

Figure 10:
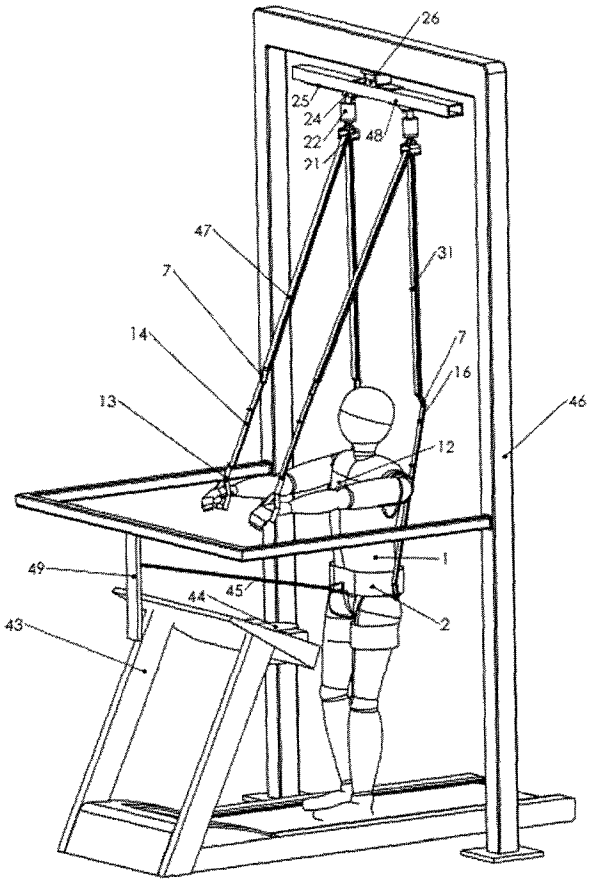
FIG. 10 is a perspective view of another variation, referred to herein as device 3.
Figure 11:
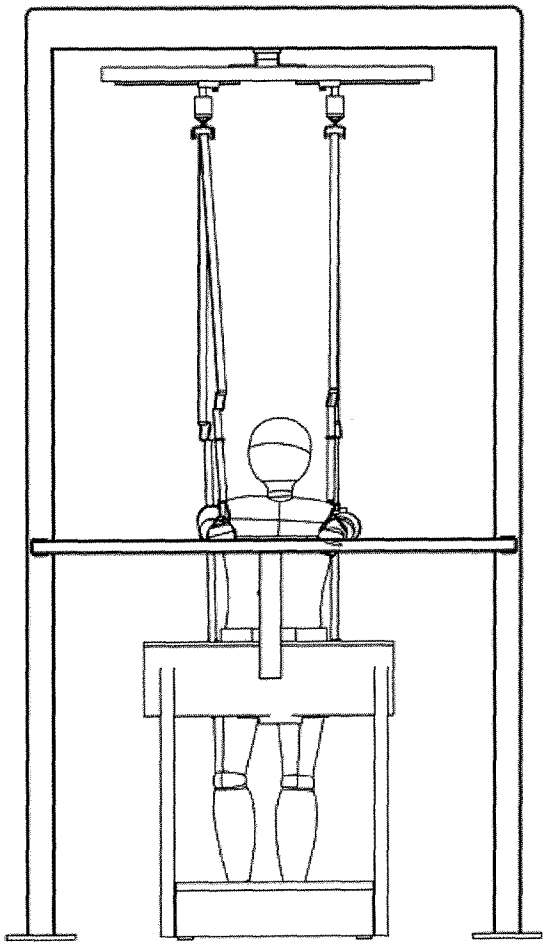
FIG. 11 is a front view of device 3 (FIG. 10).
Figure 12:
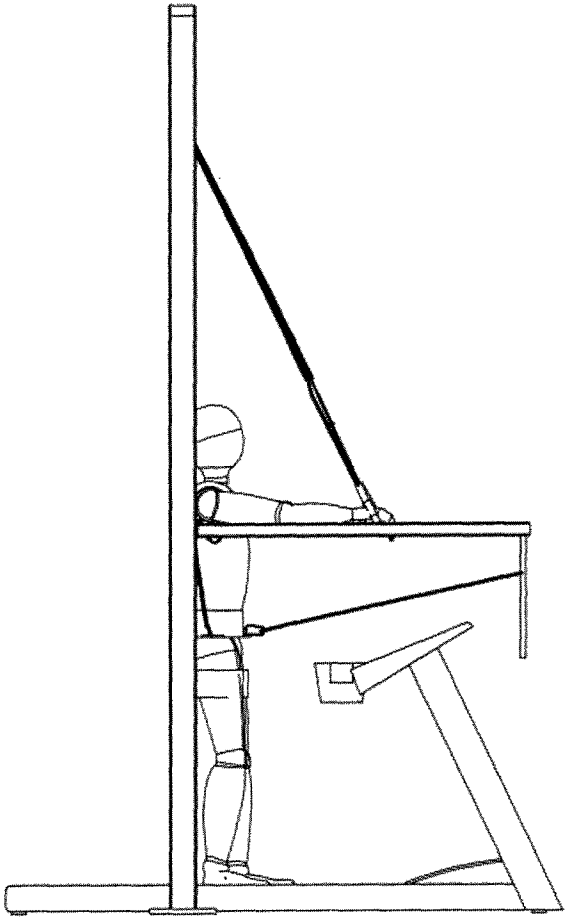
FIG. 12 is a side view of device 3.

FIGS. 10-12 show various views of another embodiment of a postural dynamics exercise systems, which is referred to herein as Device 3. In this system the person is slightly restrained/suspended in a harness by elastic bands attached at the top of rotational beam supported by a metal stand that is bolted to the floor as well as a one elastic chord attached to the person from the front support structure to the harness. The person has handles for support or can hit a drum with the hands in alternating beat for movement training while the person is walking on a treadmill.

This system can have a stand 46 that is bolted via standard concrete bolts to the floor. Device 3 has several configurations of attachments. The person 1 is slightly suspended in harness 2 connected with carbineer 7 via elastic bands 31 through a carbineer 7 connector to top bracket 21 and 22 which allows rotation about the z axis. The person 1's hands grip the two handles 13 attached to adjustable straps 14 via carbineer 7 and then attached to elastic bands 47 which are attached to rotational brackets 21 and 22 at the top. Top support beam 48 is free to rotate about bearing 26 on the z axis.

The person is restrained by one front elastic chord 45 attached to the person's harness 2 via carbineer 7 and the other end attached to height adjustable bracket 49 on support structure 46. The system is mounted over the top of a standard treadmill 43.

There is one drum mounted on the treadmill that is used for one of the exercises.

Device 3 structures can be made of various metals such as steel, aluminum or composites. The elastic bands are rubber based and can be made of various rubber compounds. As described above, in some embodiments, the system may incorporate the use of air, hydraulic, spring, or electromagnet to create a force or resistance to the system or resistance from the slide, LED lights mounted on the slide for reference point view, LED lights or meter to indicate force level person is exerting on system.

The exercises of the Device 3 are as follows:

Motions: Walking, jogging, running and side to side with/without front elastic. Backwards, and turning while walking.

Attachment configurations:

With/without shoulder strap 12

With/without handles 13

With/without use of drum 44

With/without front elastic 45

Another embodiment of the PDES is described below. This embodiment is a modular system using a single base device, referred herein as Device 4, to achieve many of the movements described above for Devices 1-3.

Figure 13:
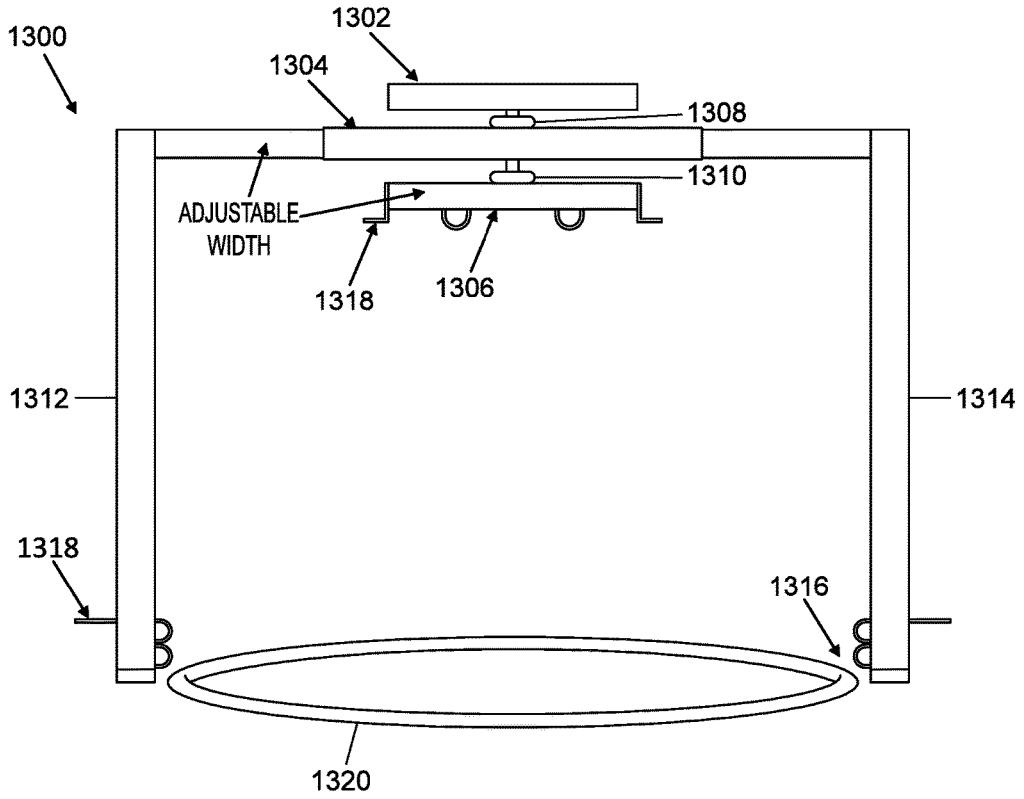
FIG. 13 is a front view of another embodiment of a PDES referred herein as Device 4.

Device 4: As shown in FIG. 13, in some embodiments, the base product of the PDES 1300 includes an anchor 1302, a first support structure 1304, and a second support structure 1306. The anchor 1302 can be a bar, a disc, a cross, a square, or any other shaped structure that can be securely attached to a fixed structure, such as a ceiling joint or a stand. For the purposes of illustration, the anchor 1302 will be described as Bar 1, but it is understood that the anchor may be another type of structure as described above. Bar 1 may rigidly attach the PDES 1300 to a fixed structure (either a fixed structure, a portable version of same, or the ceiling joists of a wood structure) and supports the top bearing 1308. The first support structure 1304 can have a pair of arms 1312, 1314 that extend both horizontally and vertically. For the purposes of illustration, the first support structure 1304 will be referred herein as Bar 2, but it is understood that the first support structure may be constructed out of a different structure than a bar. Bar 2 is connected to the top bearing 1308 and supports the bottom bearing 1310. Next, the second support structure 1306, which will be referred herein as Bar 3, is connected to the bottom bearing. In other embodiments, the second support bar 1306 can be made of structure other than a bar, such as a disc, cross, square or other structure. The attachments (sites for attaching, e.g., elastic bands) on the second and first support structure may be rotating (and/or may be fixed or lockable/fixable). For example, the attachments (attachment points) 1317 on the second support bar (bar 3) may be configured as rotating attachments.

As mentioned, in FIG. 13, the height and/or width of the two arms of the first support bar (bar 2) may be adjusted either independently or collectively. For example, the width of the upper portion of the bar 1397 may be adjustable. Similarly, the height of the vertical support portion 1399 of each arm may be adjustable.

Bar 2 can freely rotate in relation to Bar 1 with minimal or little friction and can be able to be locked into place in any position in 15, 30, or 45 degree increments.

Bar 3 can freely rotate with minimal or little friction in relation to Bar 2 and can be locked in place in relation to Bar 2 in any position in 15, 30, or 45 degree increments.

Locking the position in fixed increments allows the user to achieve precise predetermined angles between the bars which allows the user to accurately follow a prescribed exercise regimen. In other embodiments, the bars may be locked into position in a variable increment. In some embodiments, the system can be switched between locking in fixed increments and variable increments.

In some embodiments, the fixed rotation between Bar 2 and Bar 1 and between Bar 3 and Bar 2 can be engaged/disengaged and adjusted independent of the other.

Bar 2 can have arms (vertical supports) 1312, 1314 that hang down, and are wider than Bar 3, such that the attachment points 1316 at the bottom of the vertical supports can be adjusted in width (distance between the other attachment point) and height (distance from the ground) independently. The arms (vertical supports) may be either removable or retractable so as to not interfere with the user if deemed unnecessary at that time. In some embodiments, the vertical portion of the arms is completely vertical, while in other embodiments, the vertical portion can be oriented at an outward angle such that the bottom of the arms are space more widely apart than the top of the arms. In some embodiments, the angle of the arms is adjustable from a vertical position to an outwardly angled position. In some embodiments, the outward angle can be between 0 and 45 degrees.

In some embodiments, there can be pegs 1318 to which standard weights can be attached and secured to either Bar 3 or the arms (vertical supports) 1312, 1314 of Bar 2 to increase the bar's rotational inertia. These pegs 1318 can be located such that the weights that are attached will not interfere with the rotation of any bar.

In some embodiments, an optional add-on to the bottom of the arms/vertical supports is a half-circle or half-diamond support structure 1320 with the option to extend to a full circle or diamond shape. The size of this optional add-on depends on the adjustments of the vertical supports and the height of the user.

Optional add-on friction devices that create friction on either the top or bottom bearing, can be engaged or disengaged based on user's need (it can be two separate devices, one for top bearing and one for bottom). The different locked and unlocked positions of the device are being used for a series of movements performed with the guidance of an instructor and/or video/manual, or on ones' own. In addition, as described above, other types of device can be used to provide a counter force to rotation of the bars, such as a spring, hydraulic actuator, or magnet. Stiffer elements, e.g., non-elastic pieces, e.g., made of one or more of metal, plastic, and/or wood, may be used to provide force against the body. For example, in the third (Phase 3) configuration, when the subject is standing on the floor, one or more rigid or semi-rigid members may be used to provide counterforce, including the arms themselves, or one or more accessories attached to the arm, or the bar(s).

Figure 14:
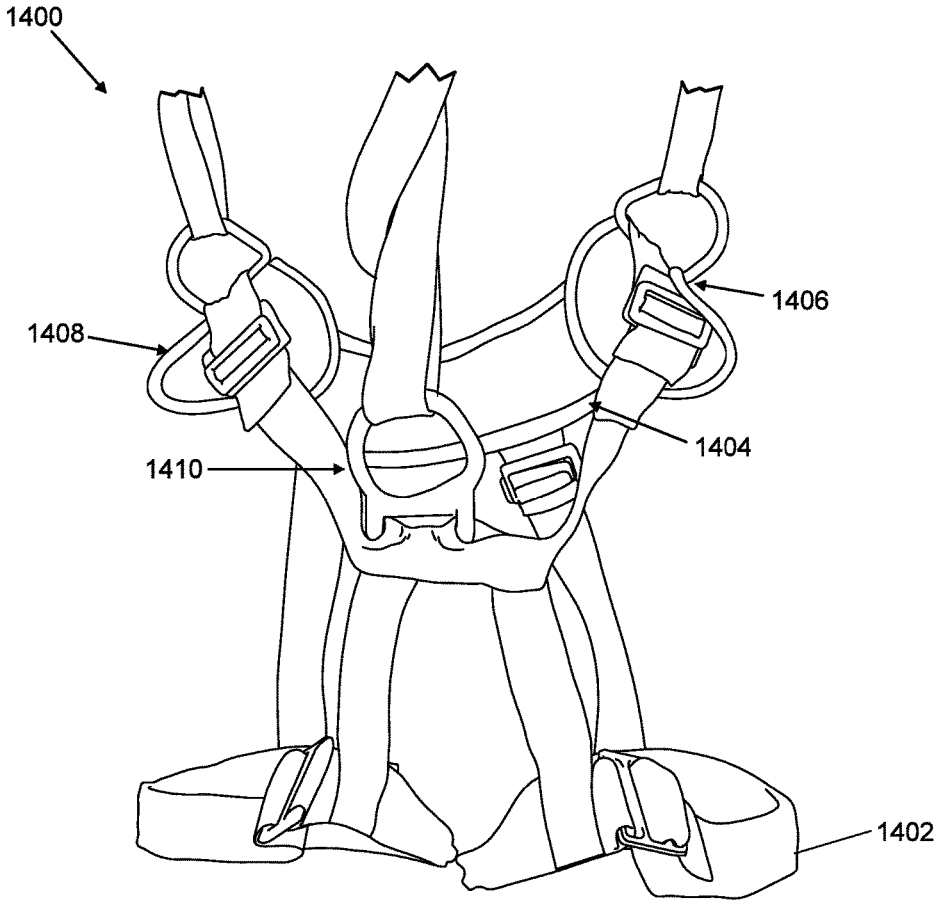
FIG. 14 is a perspective view of an embodiment of a harness.
Figure 15:
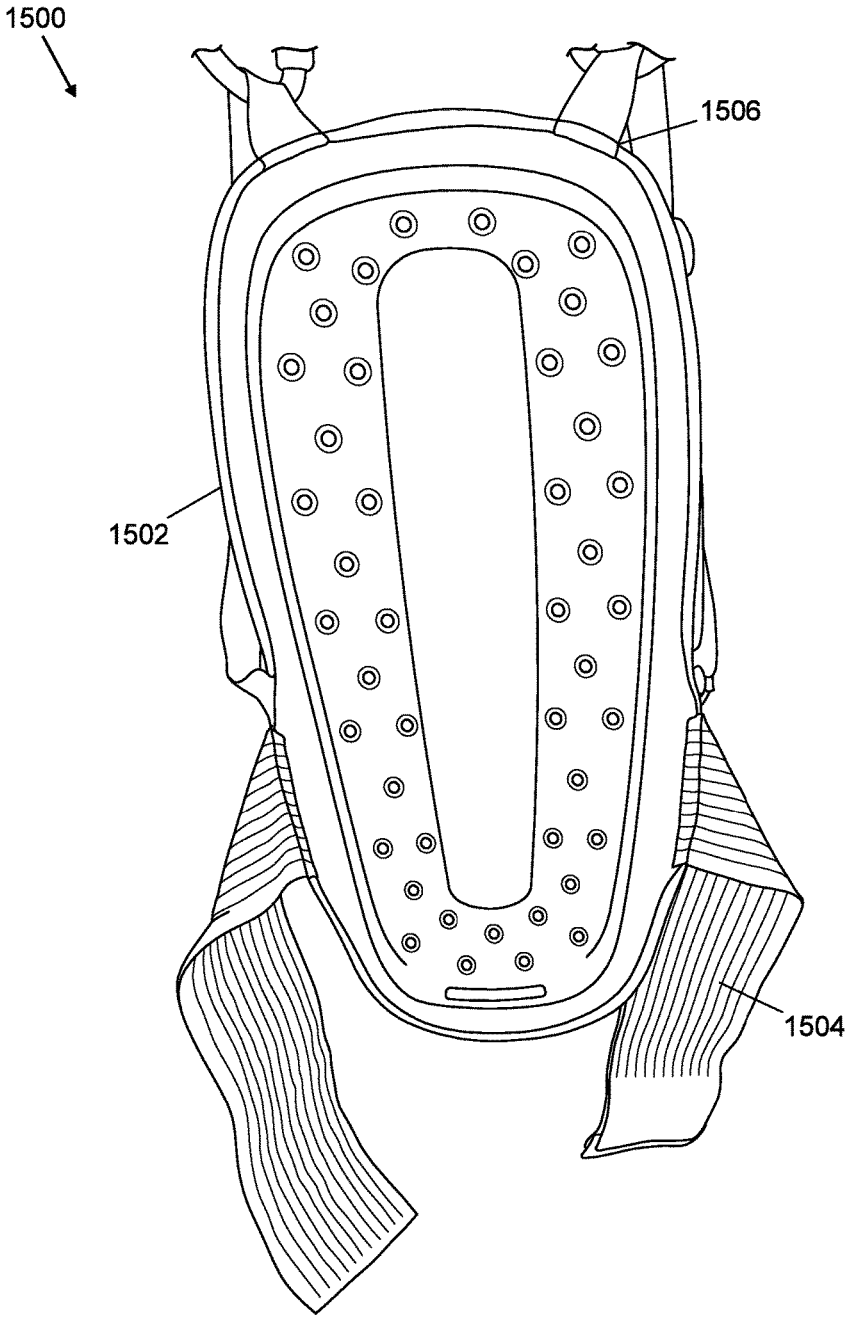
FIG. 15 is a back view of an embodiment of a backrest.
Figure 16:
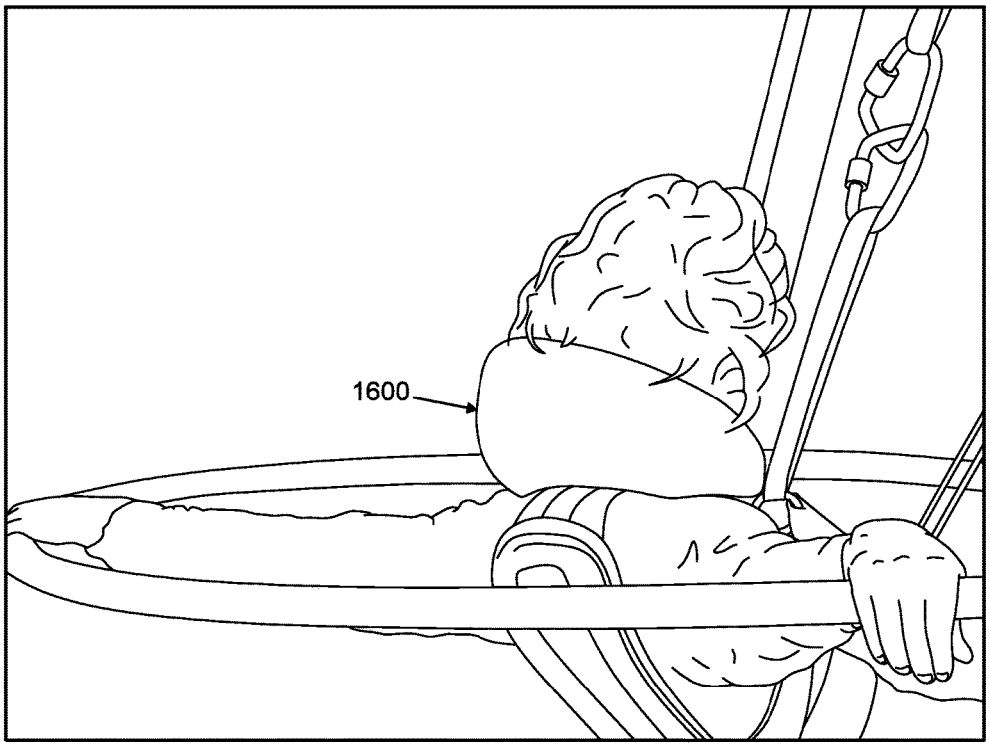
FIG. 16 is a perspective view of an embodiment of a neck support.

As illustrated in FIGS. 14-16, the use of additional gear worn by the user, i.e. harness 1400, backrest 1500 and neck support 1600 (and any additional accessories), in connection with the equipment, functions as a support as well as a restraint, directing the applied forces through oblique angles 40-45 degrees, with the aim to redefine the effect of gravity on the human organism so that it positively affects the fascial network to not only improve musculoskeletal and nervous system function, but the entire organism down to the cellular level.

The function and use of the device provides the new environment necessary for the re-education/re-patterning foundation.

- Movement execution against resistance within 360° in oblique angles 40-45°, or more broadly within angles 30-60°
- Force/counterforce
- Centerfleeing and centerseeking forces (centrifugal-centripetal)
- Inertia, gravity
- Acceleration, deceleration
- Momentum
- Oscillation—not one body structure is continuously loaded
- Tensegrity principle applied/frees the body to evoke suspension
- Tonic function (gravity response system)

Device 4 Accessories:

Harness 1400 (Refer to FIG. 14): the harness 1400 can include: a pair of adjustable leg loops 1402 that can be secured to the person's thighs; an adjustable chest strap 1404 that can be secured around the patient's chest at the level of the patient's nipples; a first pair of attachment features 1406 located on a first lateral side of the adjustable chest strap 1404; a second pair of attachment features 1408 located on a second lateral side of the adjustable chest strap 1404 such that the first pair of attachment features 1406 and the second pair of attachment features 1408 are located on opposite lateral sides of the person chest when the harness 1400 is worn by the person, and where the second pair of attachment features 1408 can be removably attached to elastic members; and a frontal attachment feature 1410 located between the adjustable chest strap 1404 and the pair of adjustable leg loops 1402. The material on the front of the leg straps 1455, 1457, and the medical sides of leg loops 1402 may be softer with little stretch, while the back straps may be wider (e.g., 2 cm). The medial side of the strap 1402 (the inside region where the harness contacts the thighs) may be made softer than other regions, e.g., and may be padded, etc., to enhance comfort in the crotch region.

Backrest 1500 (Refer to FIG. 15): the backrest 1500 can have a back support structure 1502 and may be made from a flexible or bendable, but supporting material that include semi-rigid materials that allows bending (e.g., and may include flexibly connected rigid materials). The harness may also include a belt 1504 and shoulder straps 1506 for securing the backrest to the user's back.

Neck Support 1600 (Refer to FIG. 16): the neck support 1600 can wrap around the back and side portions of the patient's neck and can be made of a resilient and/or cushiony material.

Figure 17:
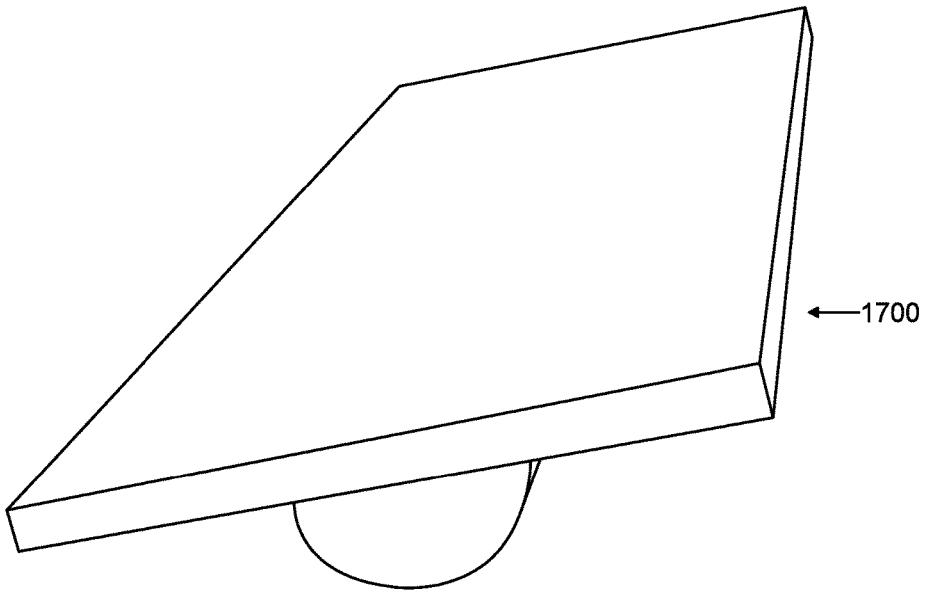
FIG. 17 is a perspective view of an embodiment of a single footpad for two feet.

Single Footpad 1700 (Refer to FIG. 17)—the single footpad 1700 for both feet can be adjusted to different angles 20 degrees, 25 degrees, and 30 degrees, for example. The single footpad can have a depth of 13 cm and a width of 39 cm.

Figure 18:
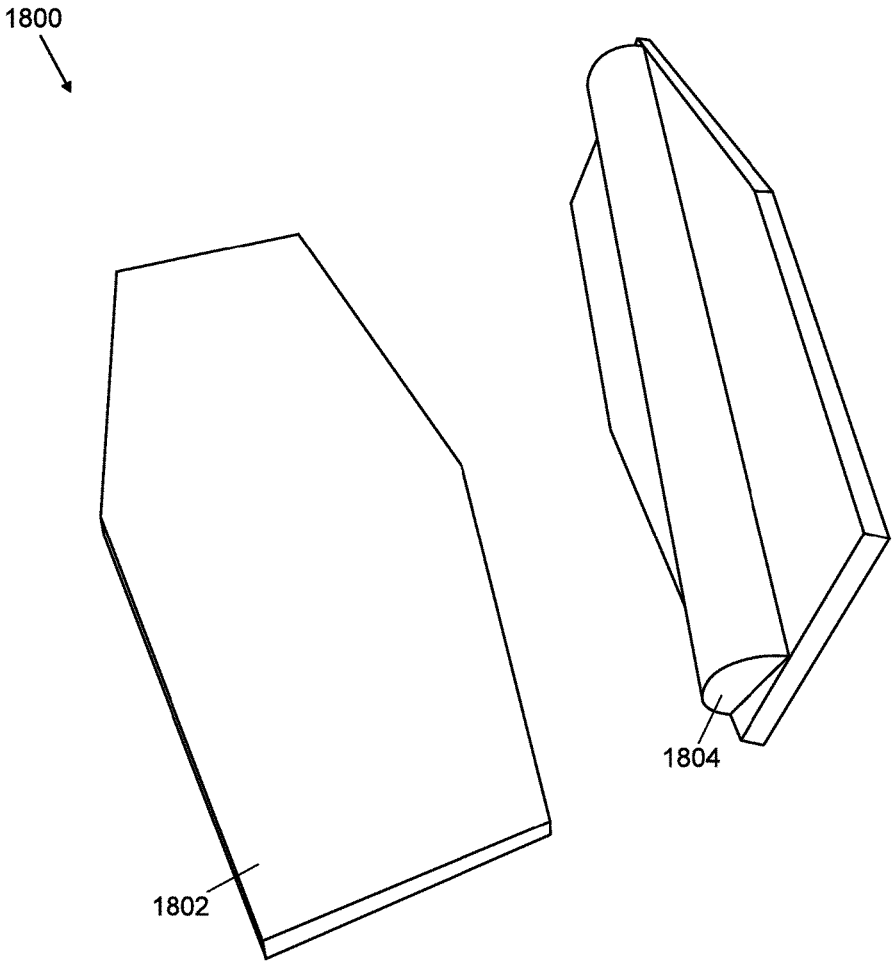
FIG. 18 is a perspective view of an embodiment of two independent footpads.

Pair of Independent Footpads 1800 (Refer to FIG. 18)—the independent footpads 1800 can have a base plate 1802 and half-round bars 1804 mounted on angles on the bottom of the base plate 1802.

Figure 19:
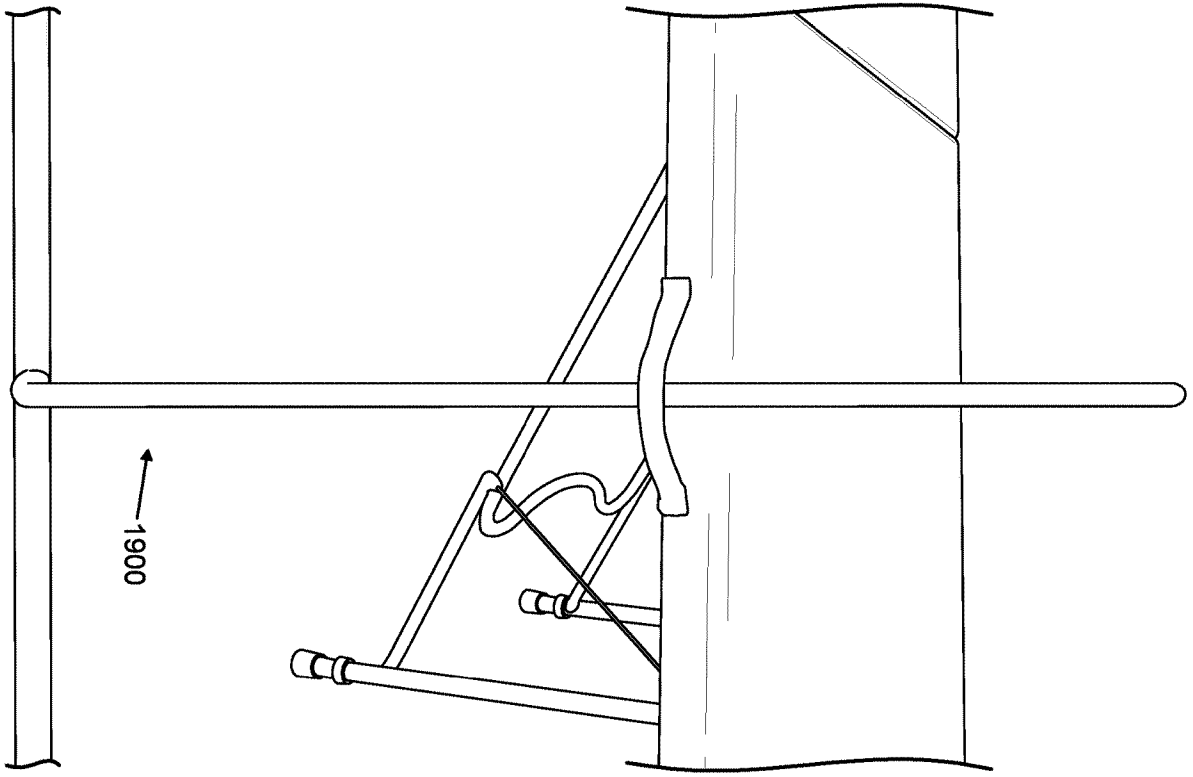
FIG. 19 is a front view of an embodiment of a stabilizing bar.

Rod 1900 to horizontalize sitbones (Refer to FIG. 19): a rod 1900 can be used to assist the user in positioning the sitbones. The rod 1900 can be threaded laterally through the harness to provide proprioceptive feedback to the user on the orientation of the sitbones so that the user can orient the sitbones horizontally. The rod can have a thickness of 2.5 cm and a length of 110 cm.

Figure 20:
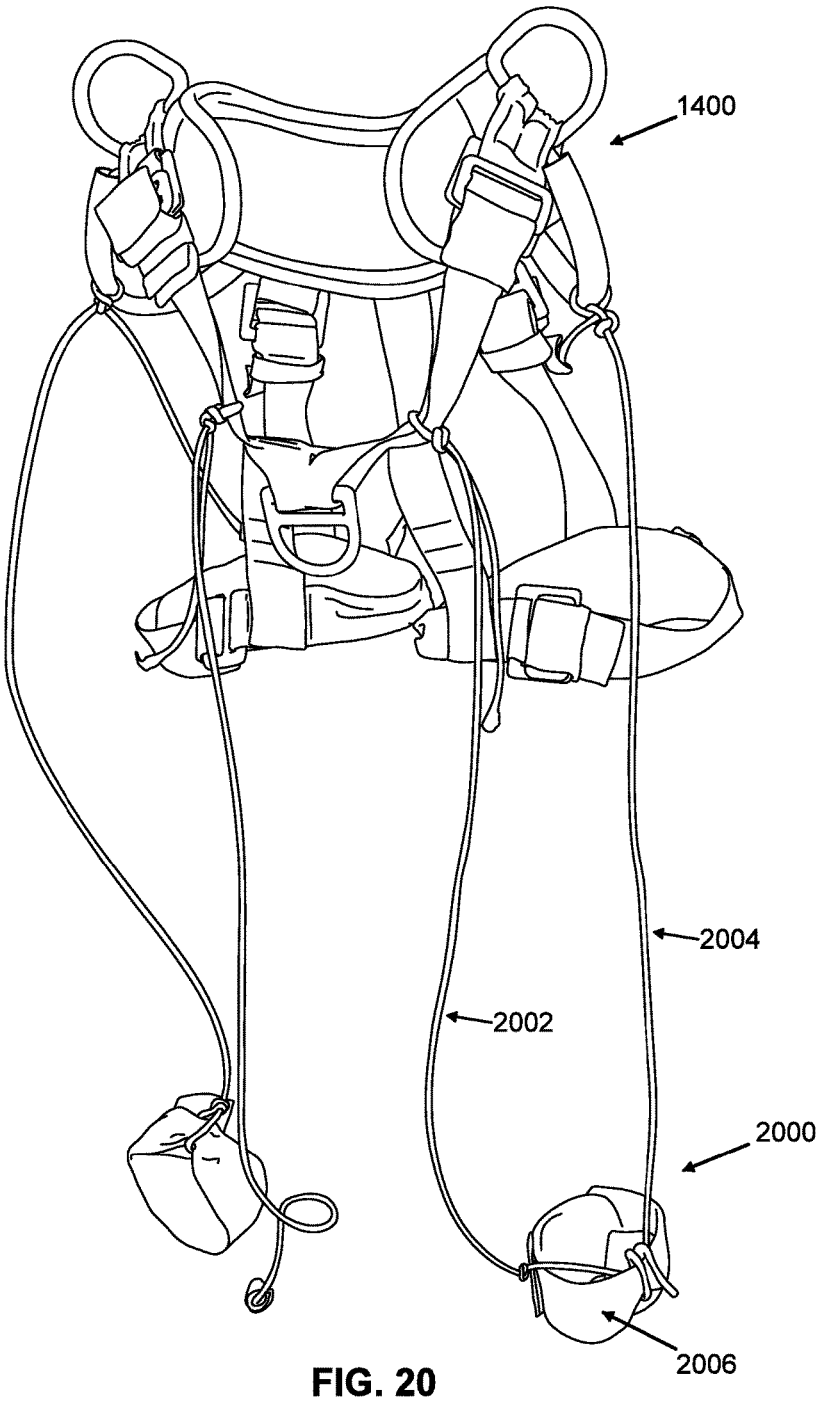
FIG. 20 is a perspective view of an embodiment of stirrups that can be used with a harness.

Stirrups 2000 can include an inner elastic cord 2002 positioned on the inside portion of the leg and an outer elastic cord 2004 positioned on the outside portion of the leg (Refer to FIG. 20) for both legs to provide tensional feedback and/or resistance to the legs. The stirrup can be attached to harness 1400. The stirrup 2000 can also include a foot loop 2006 to which the elastic cords 2002, 2004 are attached. Use of the stirrups 2000 allows the user to experience resistance or force when moving the legs in a lateral motion. The foot loop may be a soft strap that attaches under the foot (e.g., an elastic and/or Velcro strap that attaches around the users foot.

Figure 21:
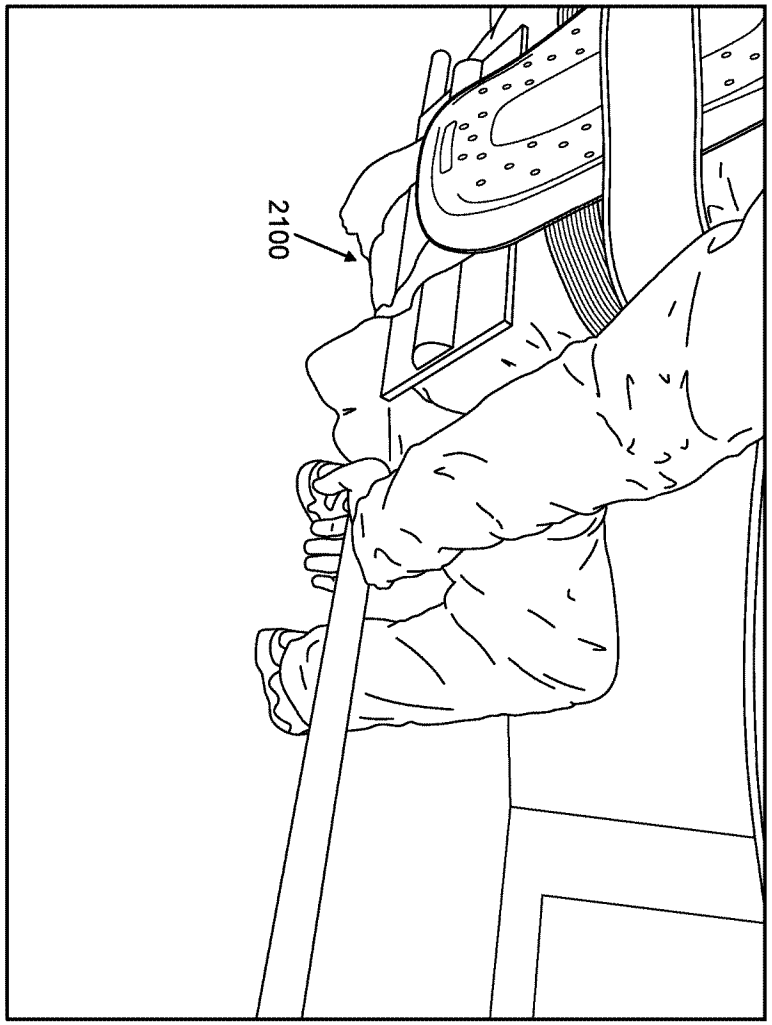
FIG. 21 is a perspective view showing an embodiment of a stabilizing bar and sacrum support in use.

Sacrum support 2100 (Refer to FIG. 21): the sacrum support 2100 can be made of a rigid or semi-rigid material and can be used in conjunction with the harness to provide additional support and proprioceptive feedback to the sacrum.

Figure 22:
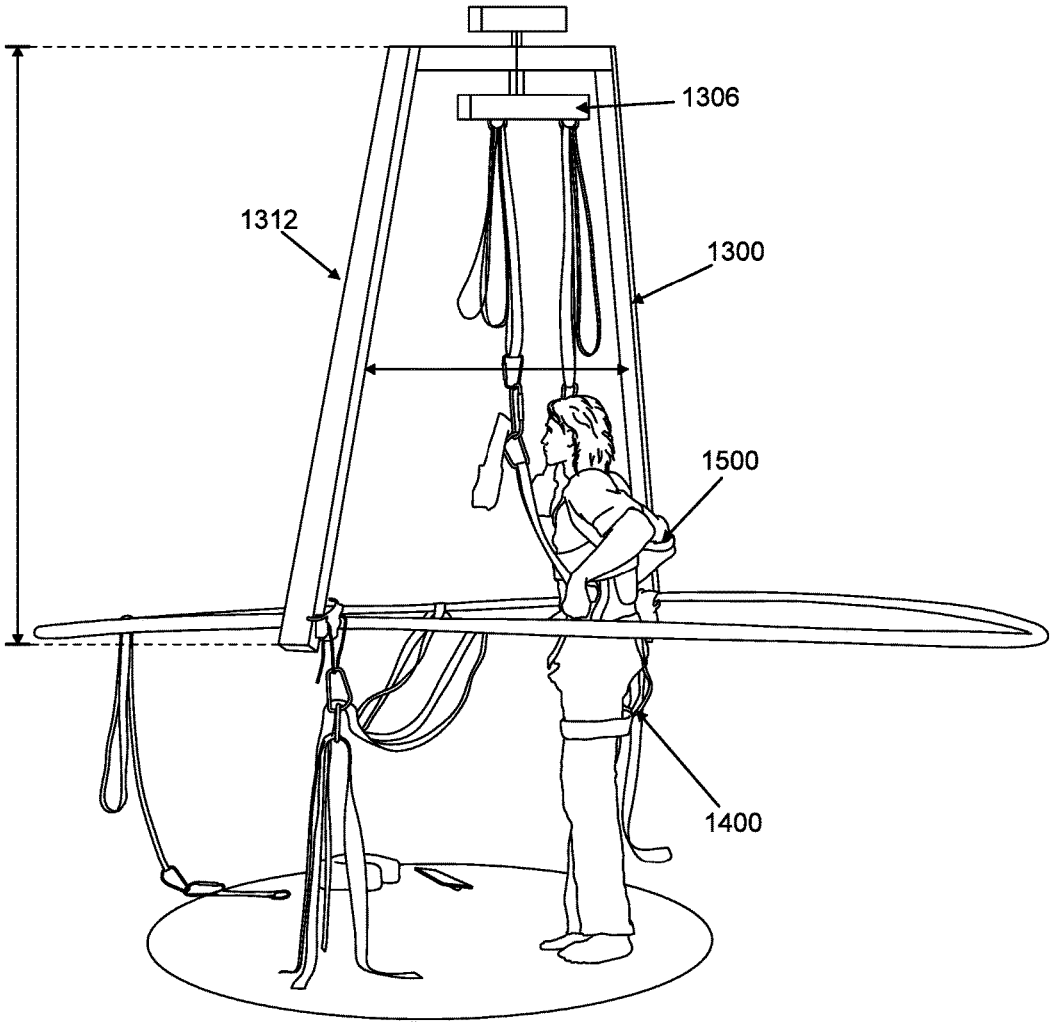
FIG. 22 illustrates the setup of device 4.

Device 4 Specifications (Refer to FIG. 22):

The device configuration shown in FIG. 22 (device 4) may be used with an 8' ceiling, and a Home Equipment version of the PDES 1300 can be used with arms 1312 having a height of 3' to 6' adjustable in 2" increments. For a 12' ceiling, a Studio Equipment version can be used with arms 1312 having a height of 7'-10' adjustable in 2" increments. The level of the arms 1312 above the floor for the different configurations can be aligned to users' hip height (illiac crest) measured in a standing position. In other words, the position of the ends of the arms 1312 can be aligned with the user's iliac crest. This can be accomplished by adjusting the height or length of the retractable arms 1312. The width between the arms can be based on the user's body height and can be adjustable from 7' to 11' in 1' increments. 9' will accommodate 165 cm to 175 cm of body height; 10' will accommodate 175 cm to 185 cm of body height; and 11' will accommodate 185 cm to 200 cm of body height. The length of Bar 3 length can be at least 35". The attachments on Bar 3 for vertical suspension elastics are adjustable in width/spacing from 24"-30", adjustable in 2" increments and may also be able to rotate (e.g., the brackets may be rotatable brackets).

Figure 23:
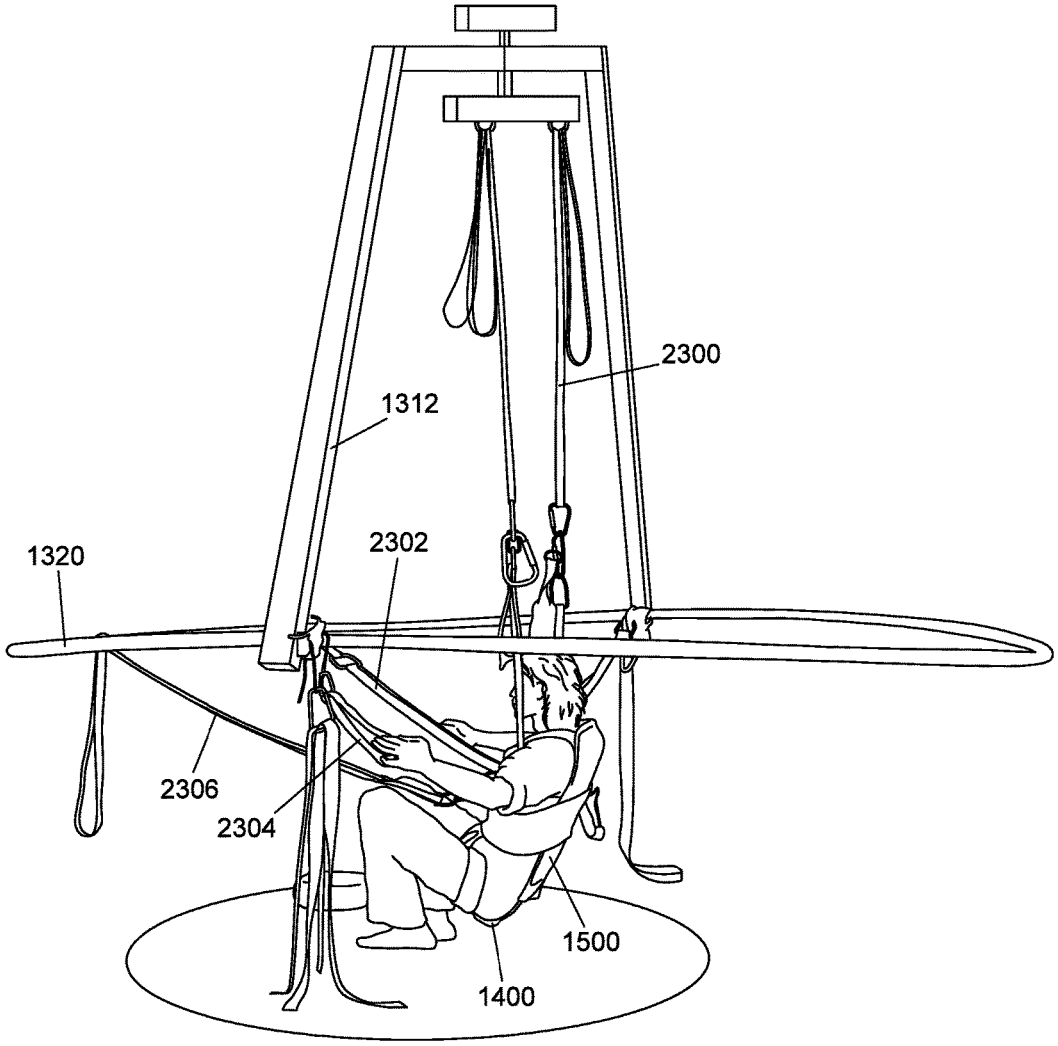
FIGS. 23-26 illustrate the setup of device 4 and the operation of the device to perform a set of movements forming a Phase One Routine.
Figure 24:
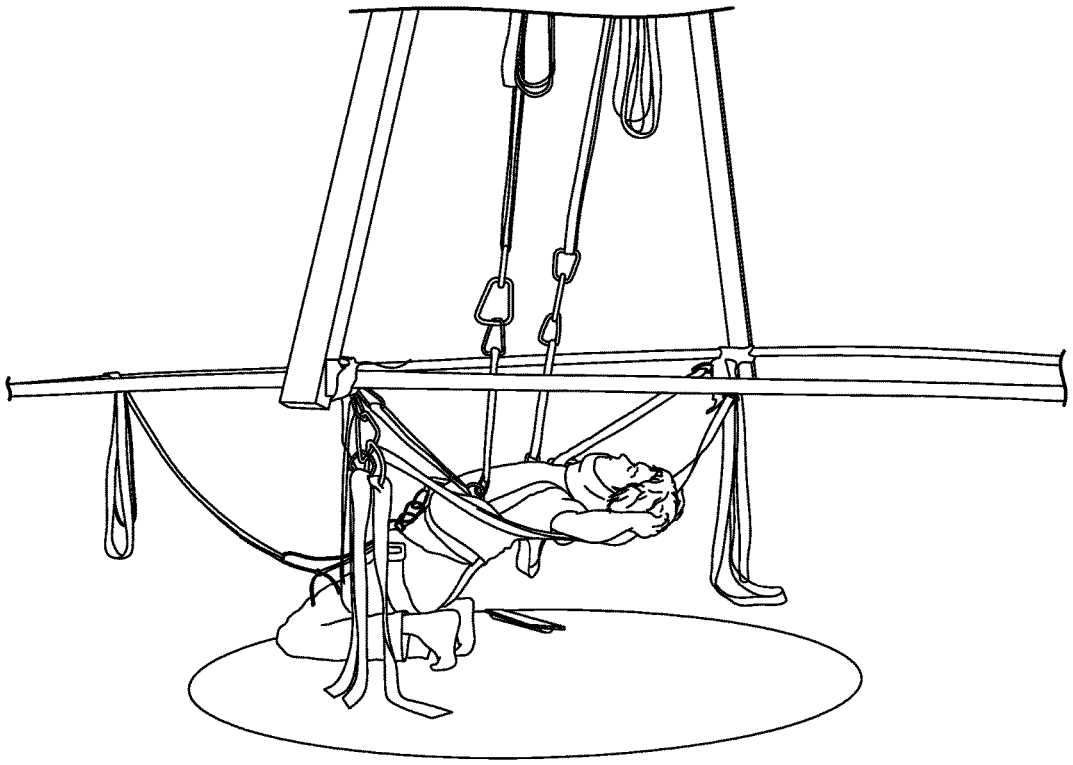
Figure 25:
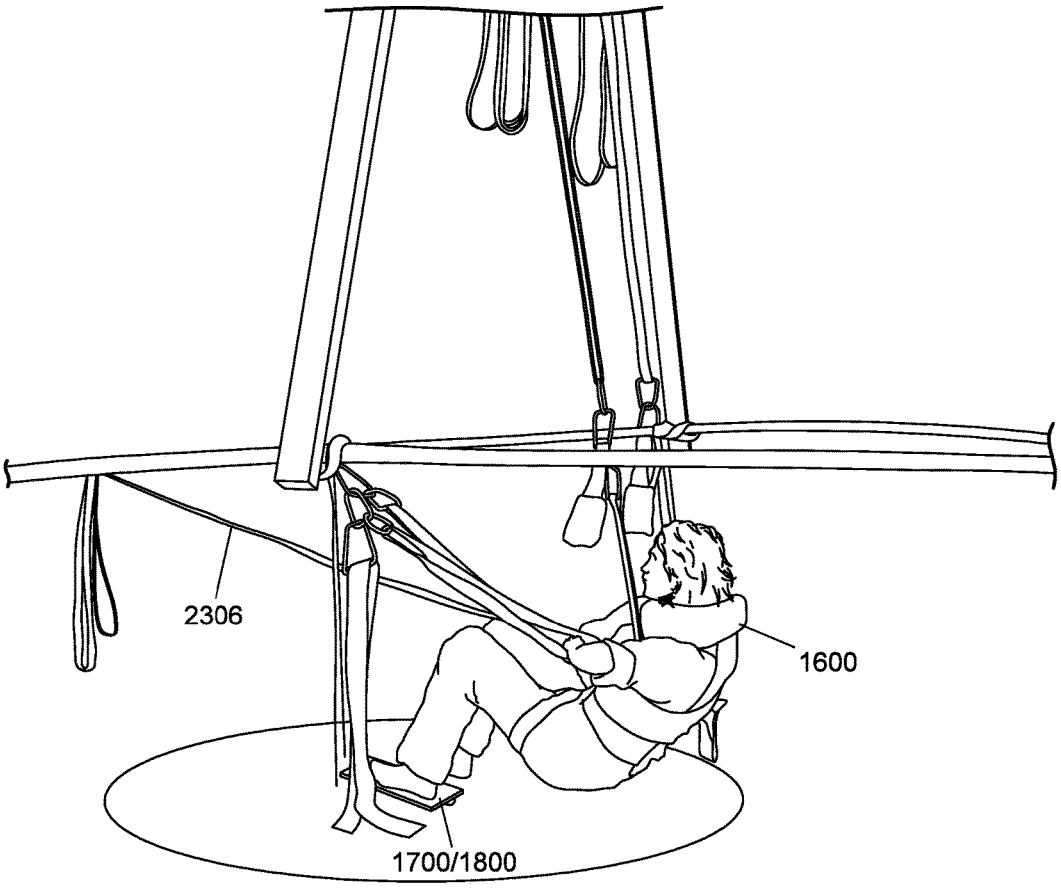
Figure 26:
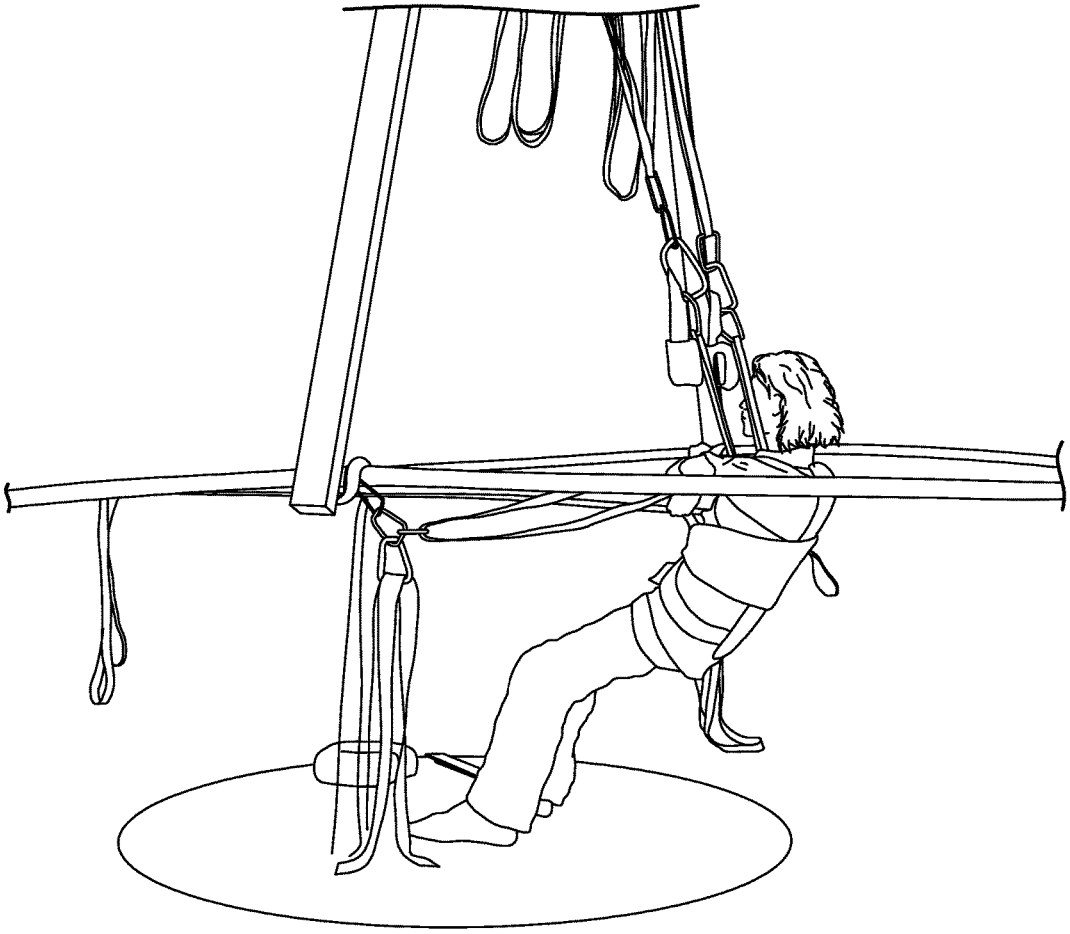

FIG. 23 illustrates how to establish the correct starting position for the Phase One Routine to facilitate Movement Execution in 40-45 degree oblique angles within a closed chain. Vertical Body Suspension Elastics 2300 attached to Bar 3 are attached to lateral rings 1406, 1408 of harness 1400. The vertical body suspension elastics 2300 can be adjusted to provide 140 lbs. of tension (elastic) for every 60 kg of body weight. The harness 1400 in combination with the Backrest 1500 function as a support to the axial skeleton (see, e.g., FIG. 14). Harness 1400: Lateral rings 1406, 1408 can be positioned to be at level of user's nipple once user is in supported squatting position. Front ring 1410 of harness 1400 can be placed between umbilicus and sternum in supported squatting position. Backrest 1500 can be tightly fitted around entire spine of user using a Velcro belt secured with a closing in front and adjustable straps around shoulders. Lateral stabilizing elastics 2302 are attached from arms 1312 to harness 1400 using the lateral rings 1406, 1408 of the harness. Lateral stabilizing elastics for upper extremities 2304 are attached at arms 1312 and come towards one's body as much as shoulder width (user is positioned in center). The user may fix these stabilizing elastics with their elbows and holds onto the front ring with both hands creating a closed chain. For example, the user (e.g., patient) can simply grasp these stabilizing elastics, which can be a loop or have a handle for grasping. Front stabilizing elastic 2306 can be attached to a center region of half-ring 1320 or to furthest point of triangle, and to the front ring of the harness (e.g., near the sternum on the harness).

Phase One Routine is Illustrated in FIGS. 23-26.

Device 4 is in locked position (Bars 1-3 all locked in position so that there is no rotation of any of the bars). The re-education/re-patterning is based on one movement as shown; squatting to standing and vice versa, executed in 40-45 degree oblique body angles, with its preparatory movements a trunk extension shown in FIG. 24 and soft elastic bounces in the end ranges of the squatting position. This angle and movement facilitates interconnectedness of the different body segments, aligns the body, minimizes stress on all of the joints, restores and rebuilds the elastic storage capacity of the collagenous structures and is the preparation for the axial skeleton to become the 'Prime Mover'. The movement can be executed both barefoot and wearing flexible sport shoes, while using a footpad 1700/1800 (or with feet directly on the ground) and neck support 1600. The front stabilizing elastic 2306 may be used alternatively during the routine, switching back and forth from closed loop control to open loop control.

Figure 43:
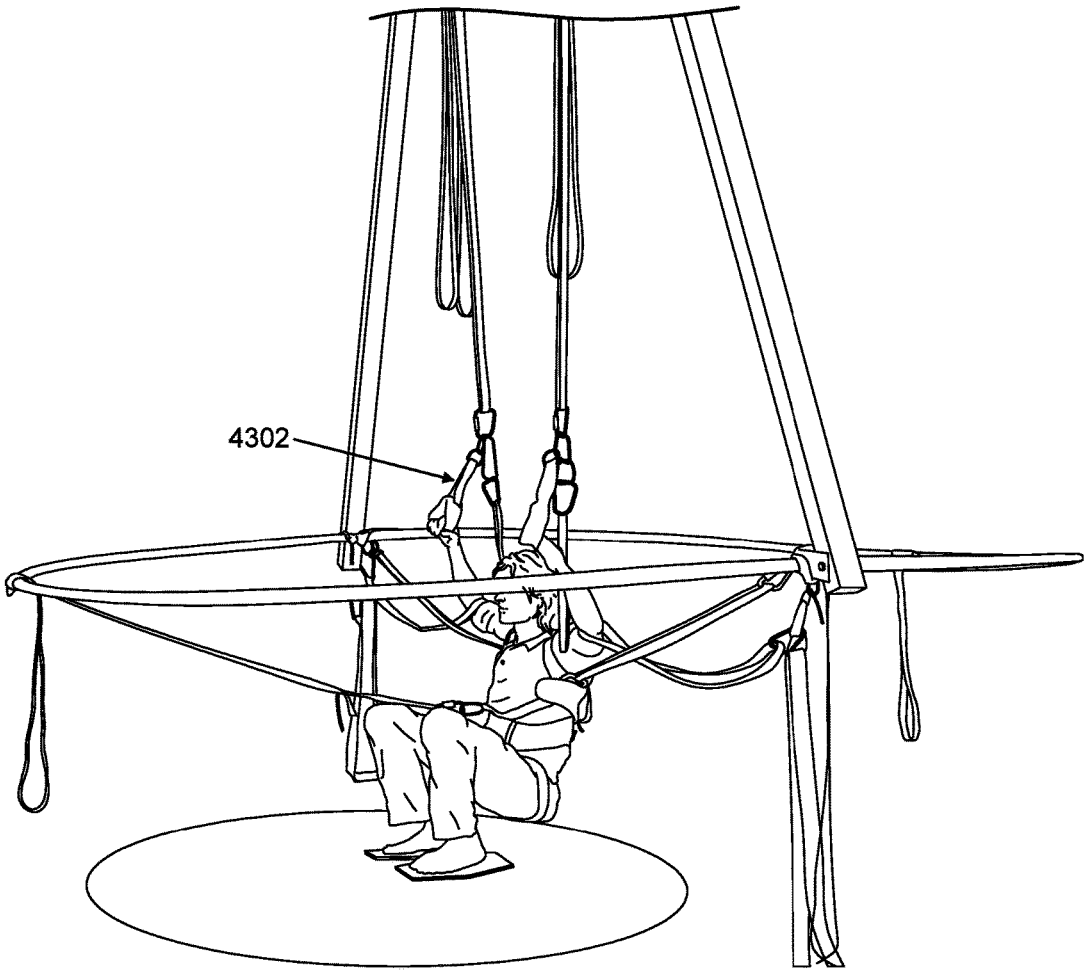
FIG. 43 illustrates one variation of the apparatus in which the person is squatting while grasping handles or loops coupled to the elastic members to acquire appropriate hip flexion and ankle dorsiflexion in the squatting position.

FIG. 43 also illustrates a user (similar to FIGS. 23-26) acquiring an appropriate hip flexion and ankle dorsiflexion in a squatting position. In this example, the person (user) is wearing the harness (as illustrated in FIG. 14) that is connected by a pair of elastic straps to the third bar (second support bar, not visible in FIG. 43), and each of these elastic straps includes a handle (shown as a loop 4302). In general, and as shown in this example, the elastic strap may be formed of a set of multiple component straps (elastic members) that may be attached in series and/or in parallel. In FIG. 43, the elastic straps connecting the harness to the second support bar include two elastic regions, connected by a metal loop to which the handles are attached. Other items, including weights which may adjust the elastic strength of the elastic members, may also or alternatively be attached. Thus, in general, the strength of the elastic members may be adjusted, e.g., by attaching weights and/or by increasing the number of elastic components (in parallel and/or in series) forming the elastic strap. In operation, the user may hold onto the straps when performing certain movements, including performing soft elastic bounces in the end ranges of the squatting position, as discussed above.

Figure 27:
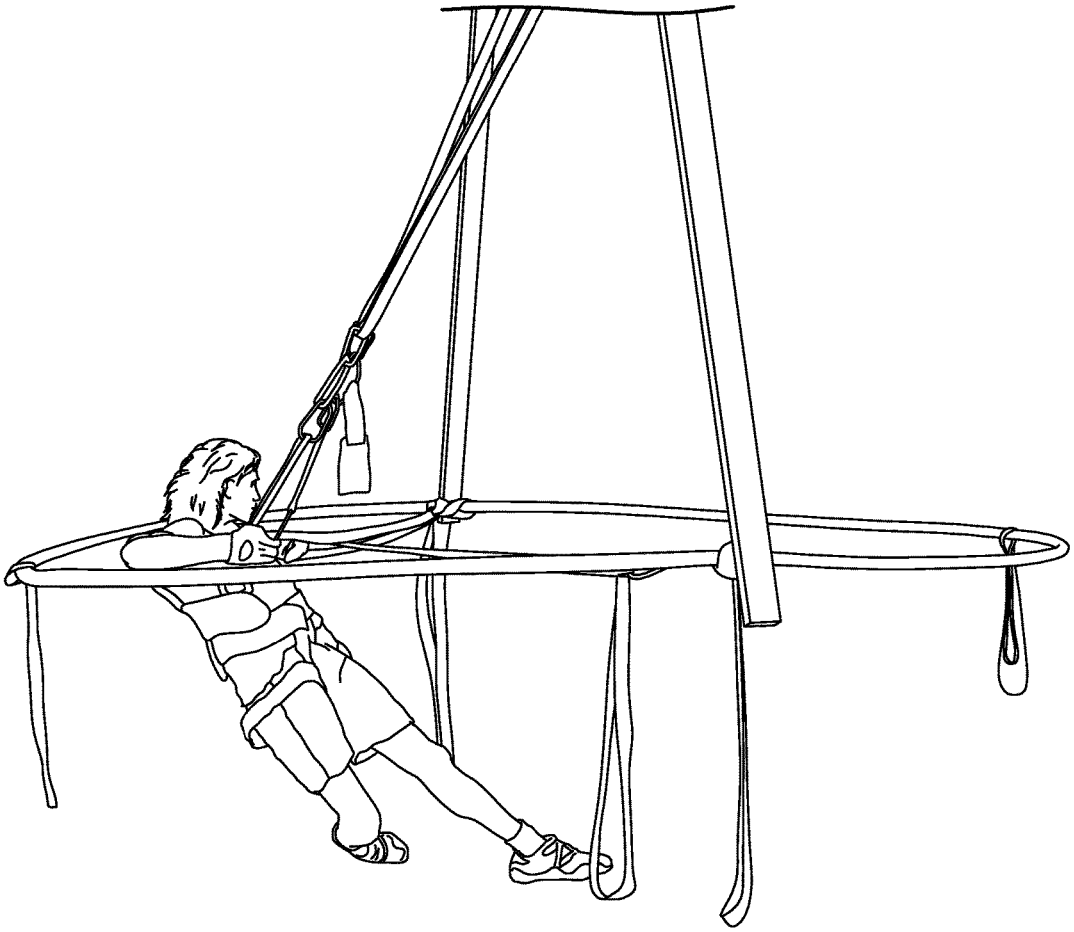
FIGS. 27-29 illustrate additional configurations of device 4 and the operation of the device in this configuration to perform a second set of movements forming a Phase Two Routine.
Figure 28:
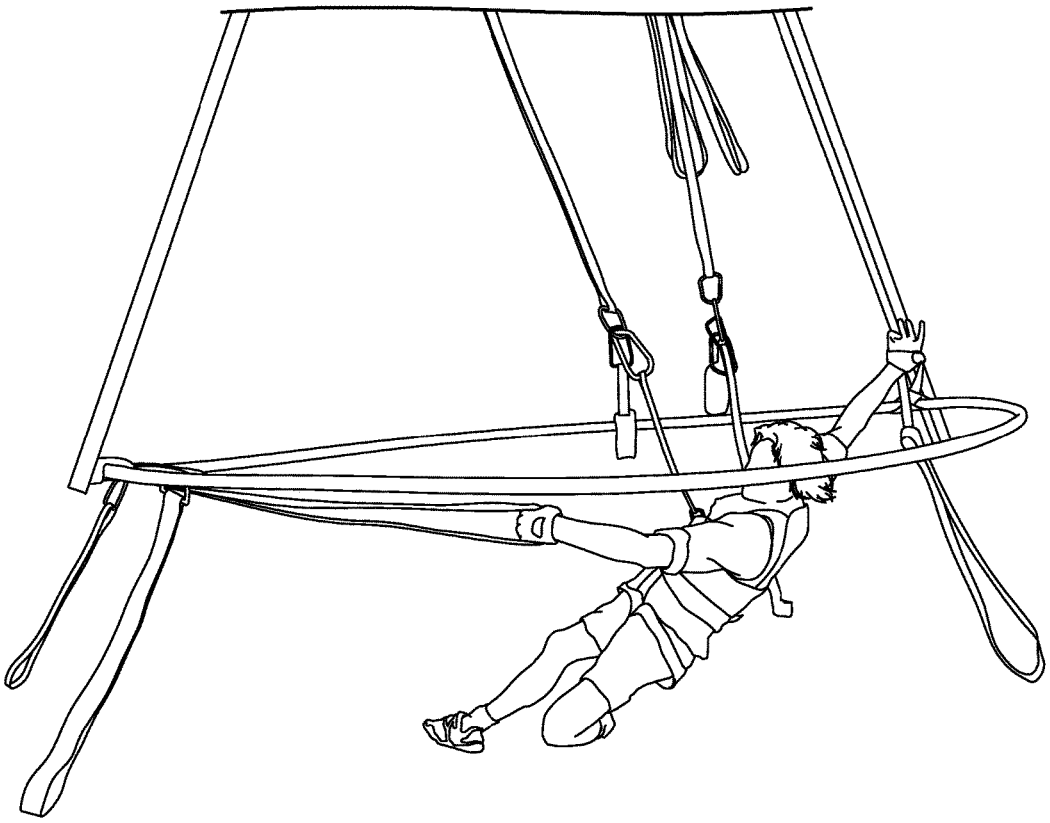
Figure 29:
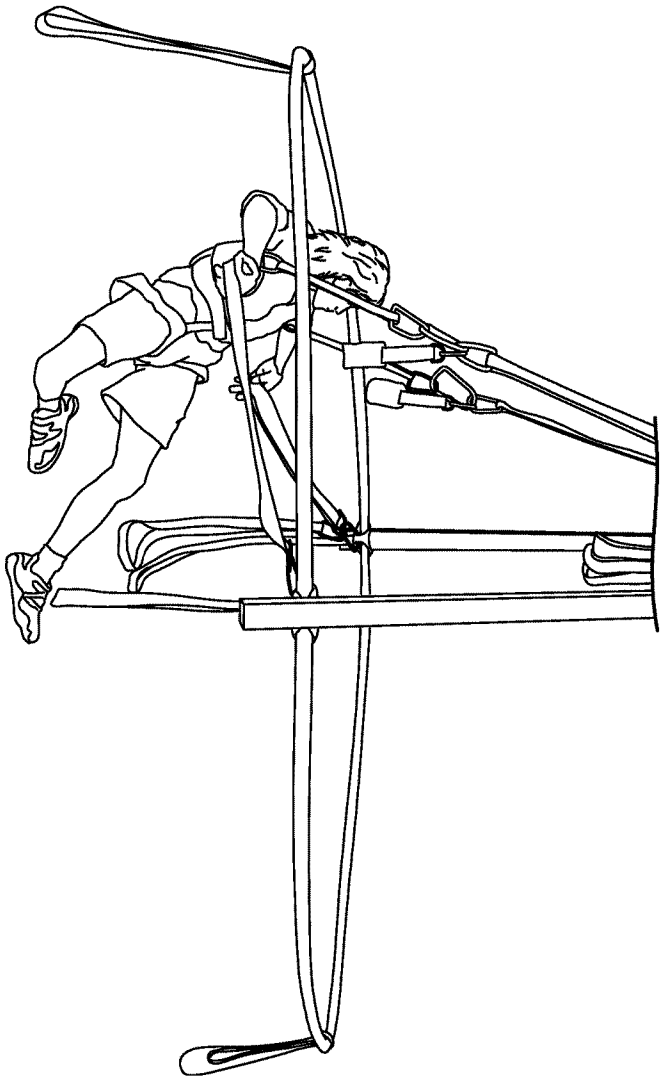

An Example of a Phase Two Routine is Illustrated in FIGS. 27-29.

Bar 2 and 3 are locked with the top bearing open for rotation, which means that Bar 2 and Bar 3 can rotate in tandem with respect to the anchor/Bar 1. The Phase Two Routine keeps everything established in Phase 1 and adds rotation of the body with the feet acting as the pivot point with emphasis on the axial skeleton to function as 'Prime Mover'. Again, the body is maintained at an oblique 40 to 45 degree angle throughout these movements. This restores and rebuilds as well as now adding the strengthening aspect of the fascial net by loading the fascial tissues over multiple extension ranges while utilizing their regained elastic springiness. Movement can be executed in flexible sport shoes with thin, gripping soles. FIG. 27 illustrates how the legs of the user are suspended from the diaphragm. FIG. 28 illustrates how the user changes and dynamically readjusts their balance with respect to weight and spatial orientation during the movement. FIG. 29 illustrates how the back can be opened while moving around.

Phase Three Routine is Illustrated in FIGS. 30-40.

Parameters established in Phase One and Phase Two may be modified with the following adjustments and variations. Omnidirectional movements can be executed both barefoot and with sport shoes. The axial skeleton is established as 'Prime Mover', which may now strengthen the entire fascial network by loading the different fascial components.

Figure 30A:
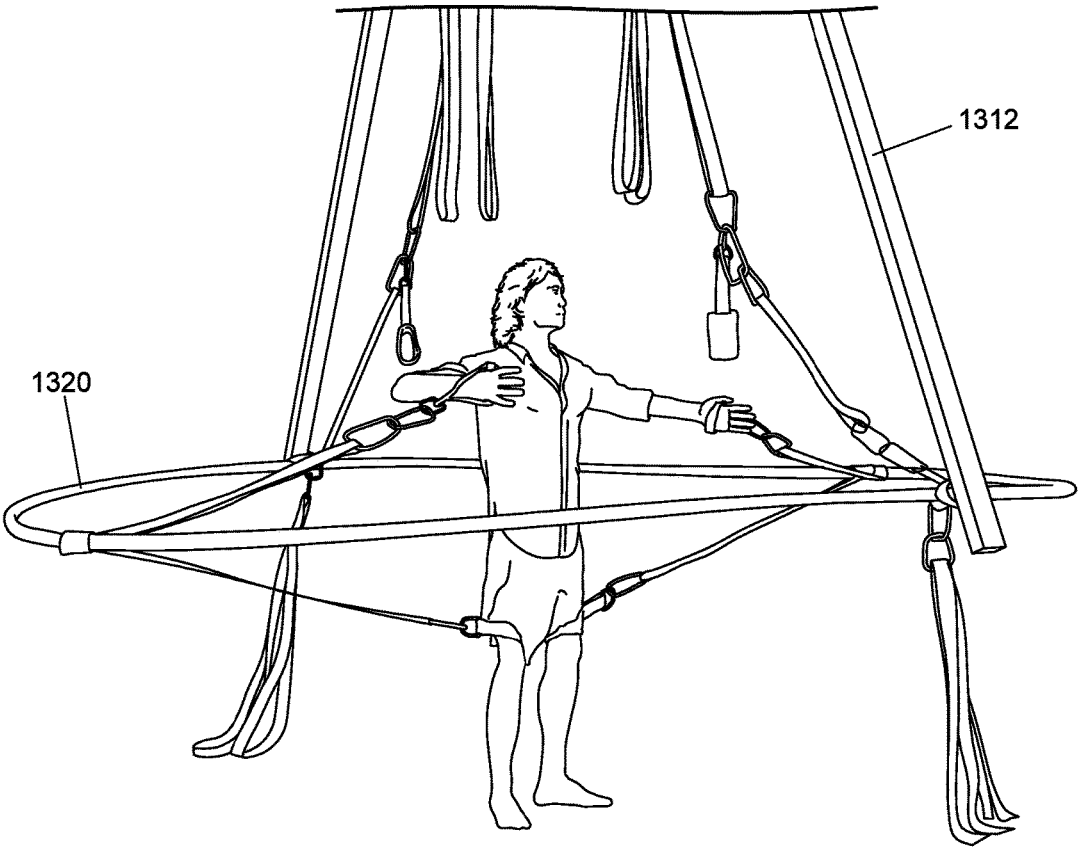
FIGS. 30-40 illustrate additional configurations of Device 4 (including the operation without a harness) and the operation of the device to perform a set of movements forming a Phase Three Routine.
Figure 30B:
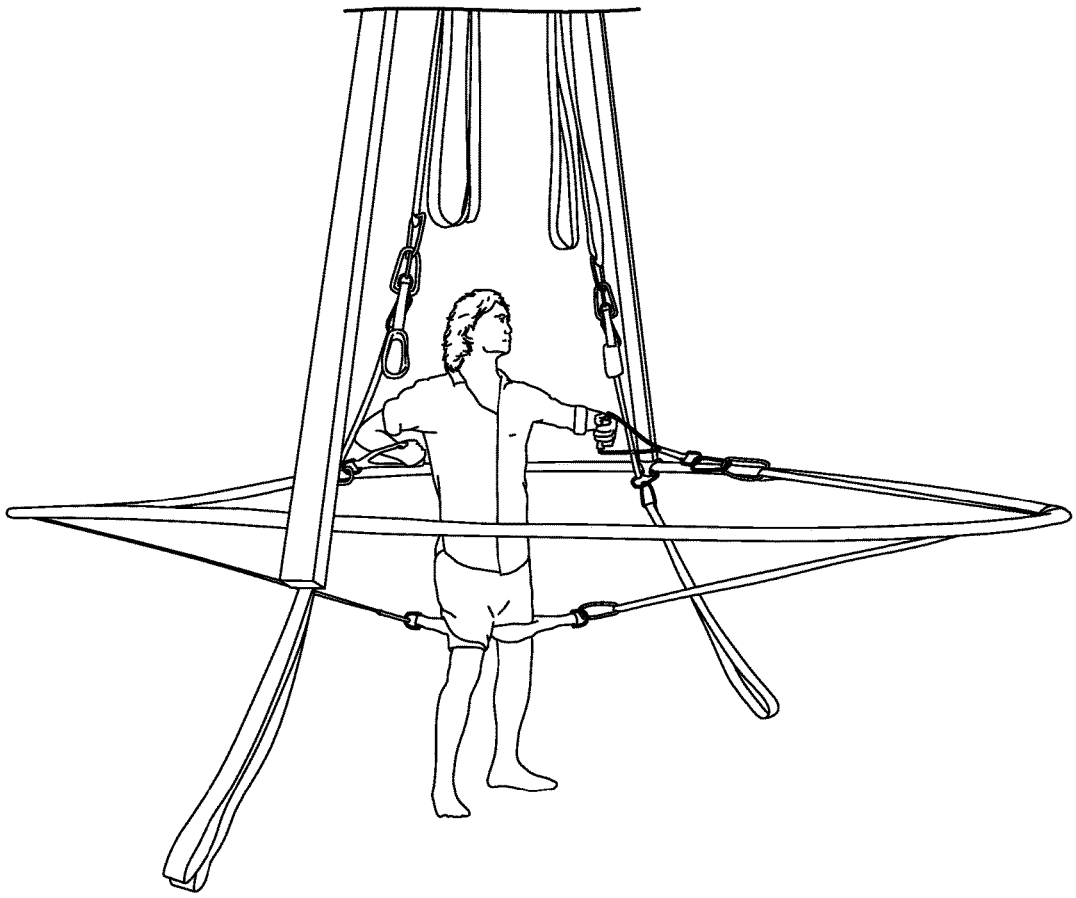
Figure 30C:
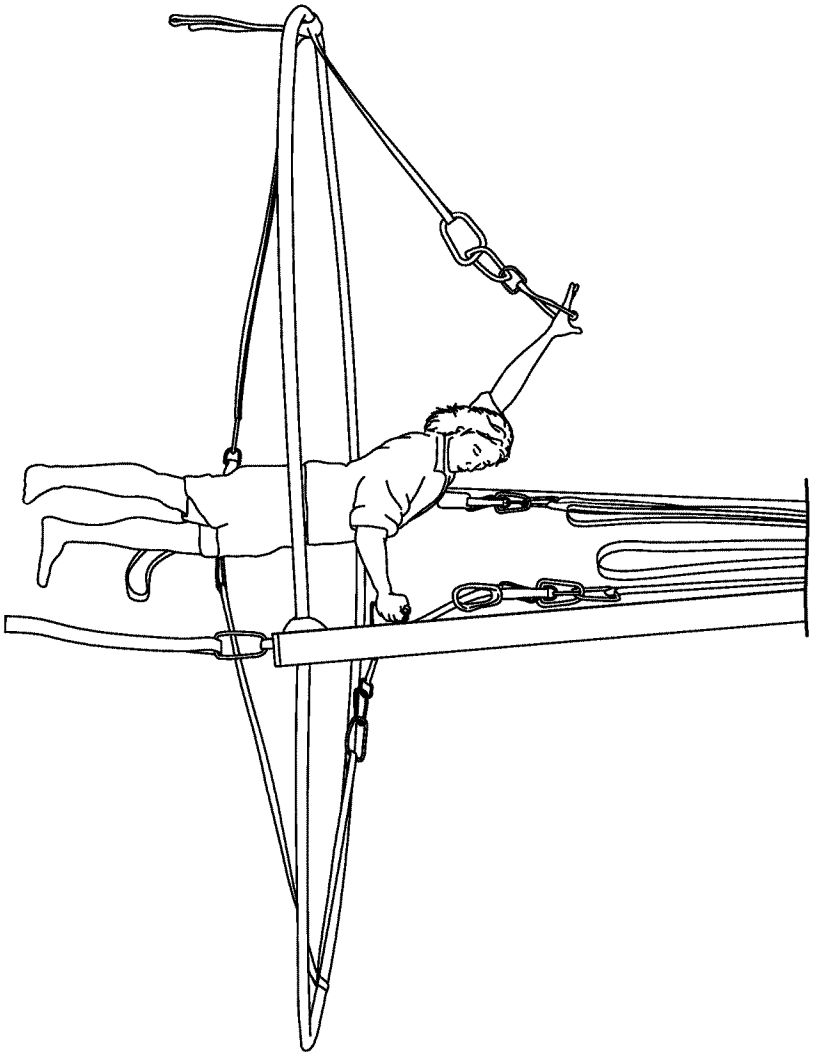

FIGS. 30A-30C illustrate an embodiment where Bar 2 freely rotates with respect to Bar 3 by unlocking the bars. In this embodiment, the user can stand vertically and does not need to wear a harness or backrest. Lateral elastics can be attached to the arms 1312 or optional support 1320 and can be grasped by the user using handles, arm loops or the like, and also attached to the user's legs. This configuration provides an interconnectedness of the hands and feet, and provides a force/counterforce experience to the user. The user's movements concentrate on rotation of the body, arms and legs around a vertical axis.

Figure 31:
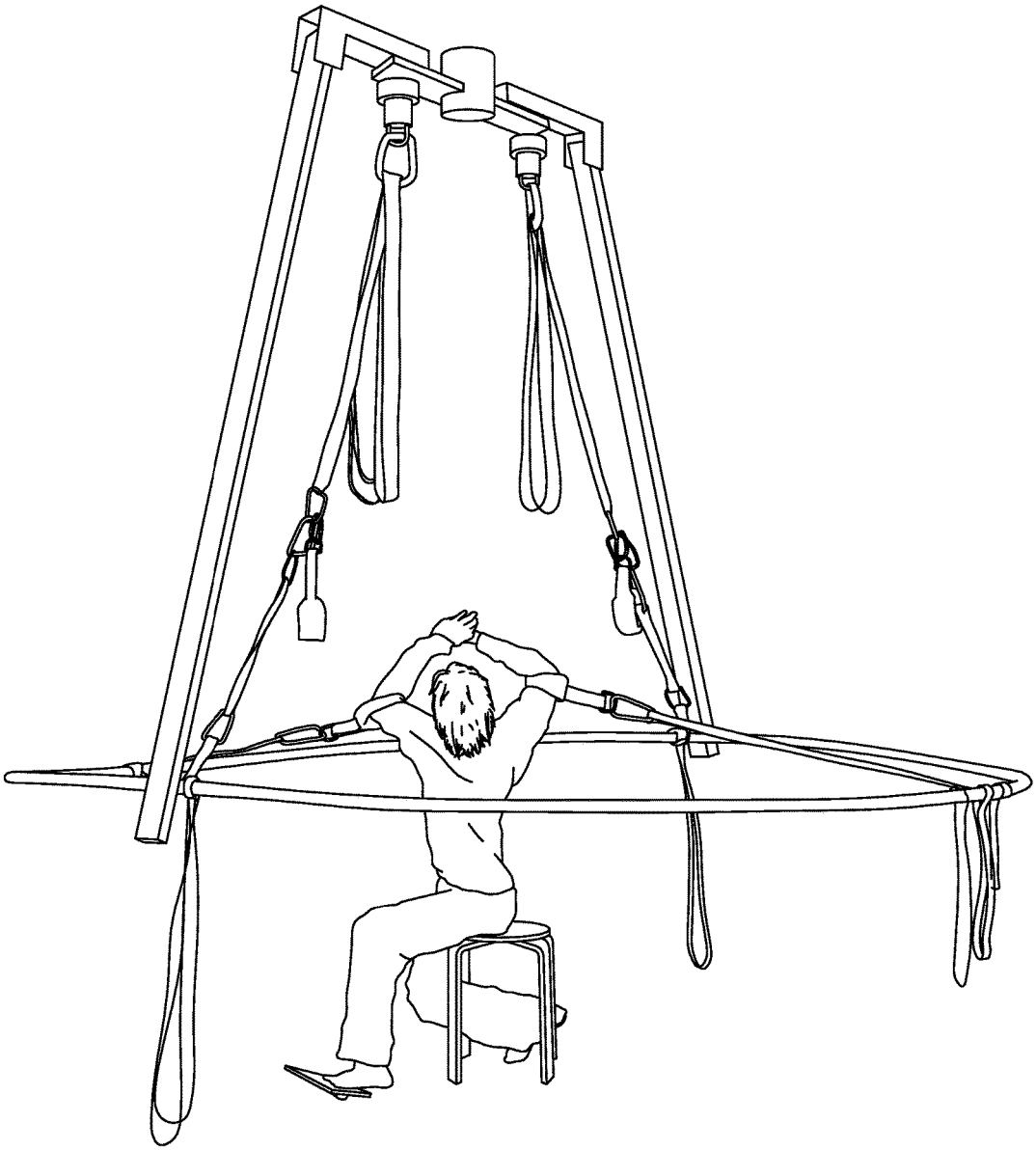
Figure 32:
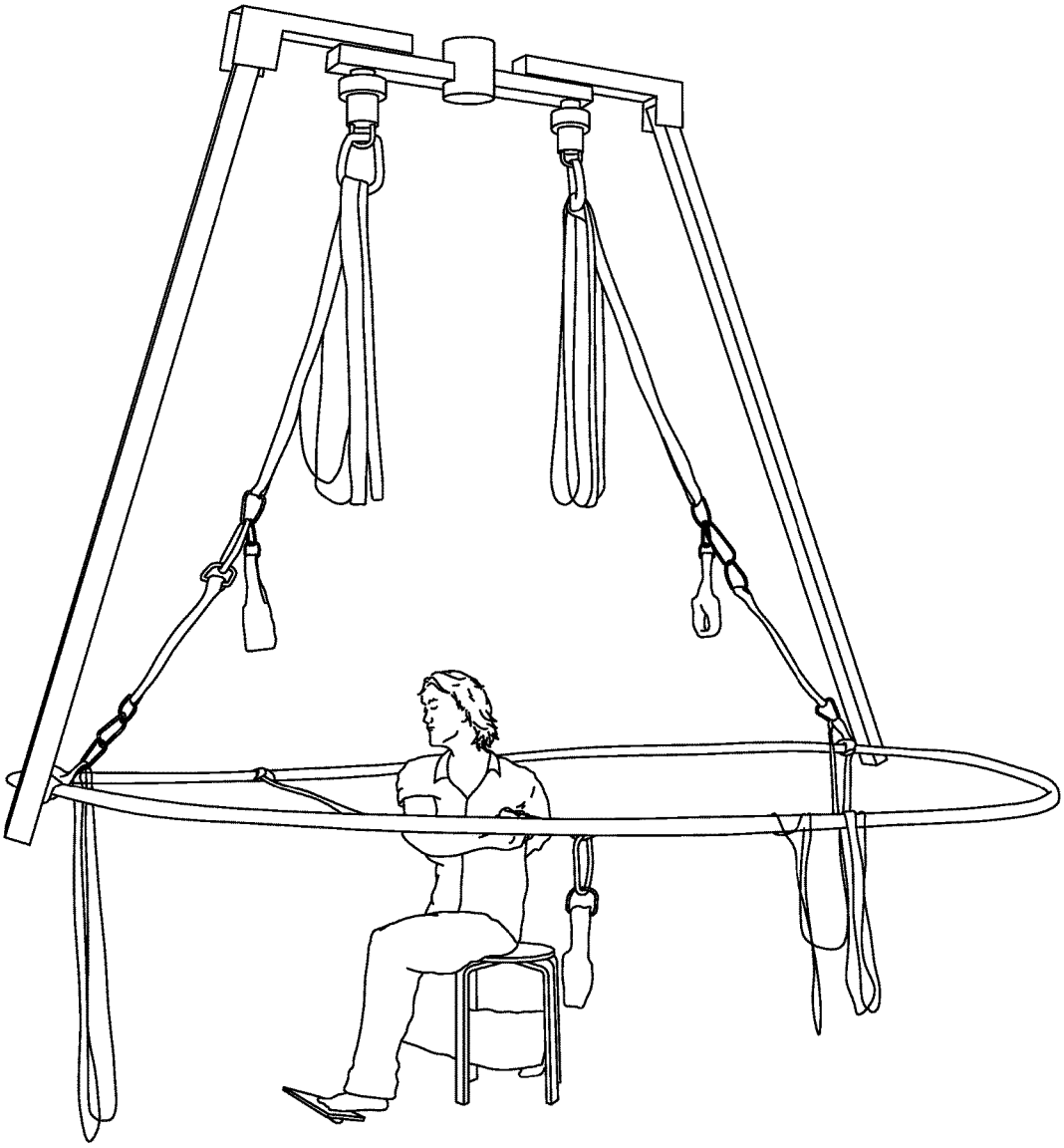
Figure 41:
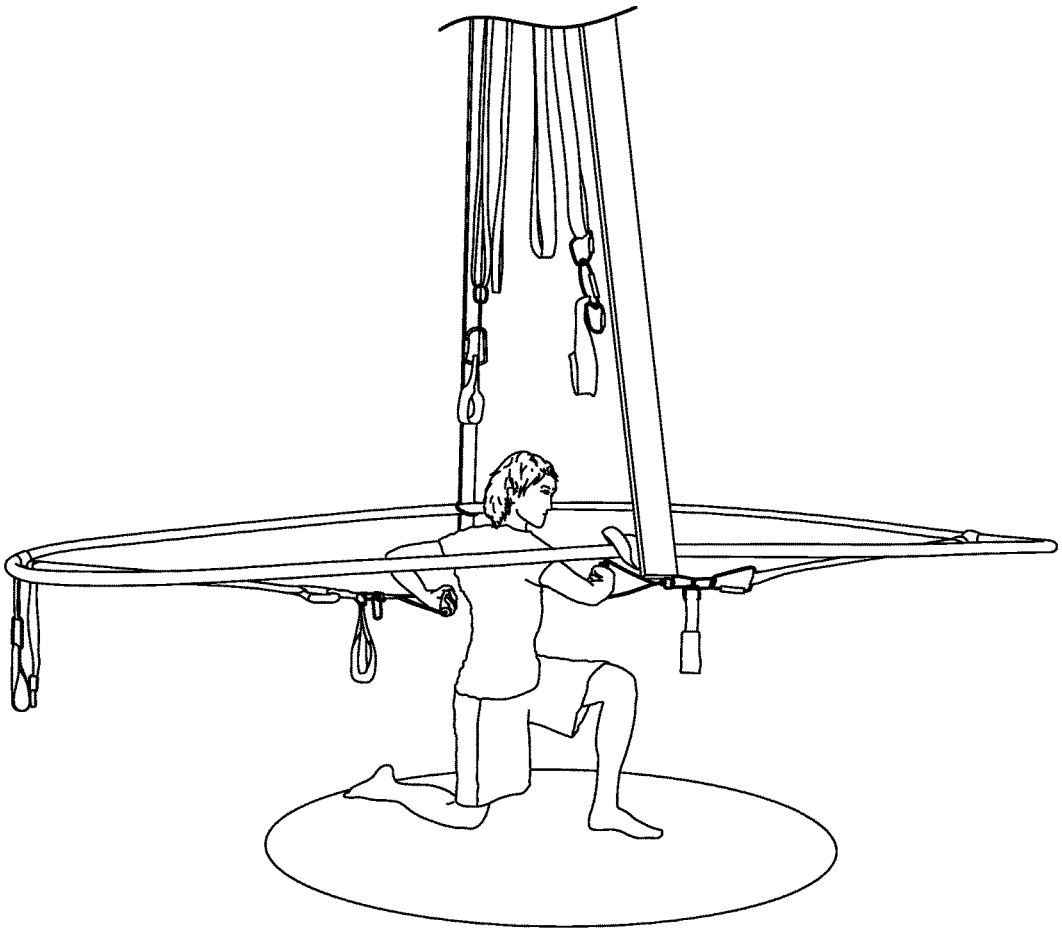
FIGS. 41 and 42 illustrate additional movements that may be performed with the apparatuses (e.g., device 4) as described herein.
Figure 42:
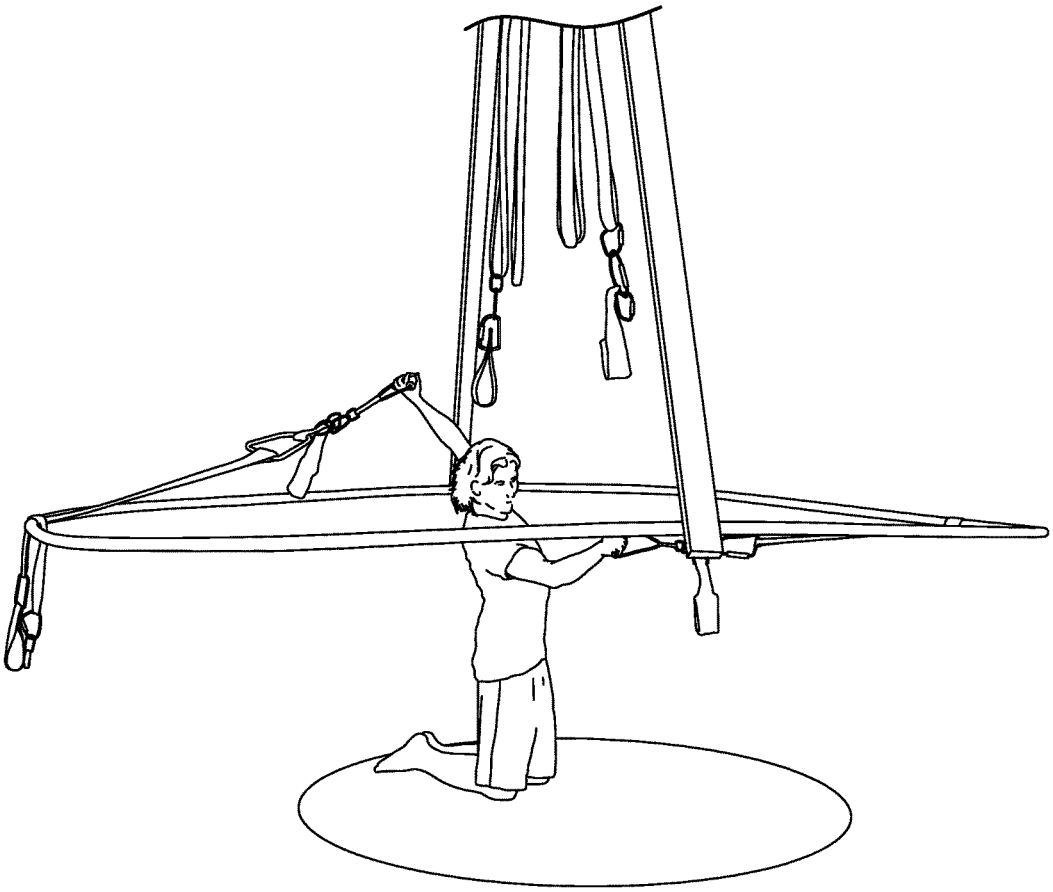

FIGS. 31 and 32 illustrate a movement variation that can be performed while sitting on a chair using various arm elastics, handles, loops, and an optional footpad, or a kneeling position as shown in FIG. 41-42. In any of the apparatuses and methods described herein, it is an advantage with these devices and methods that they may be readily adapted for use with people having injuries (including leg or other limb amputation or immobilization). For example, a user in a wheelchair or a person recovering from leg injury may use the apparatus, which can be adjusted for height and arm/shoulder.

Figure 33:
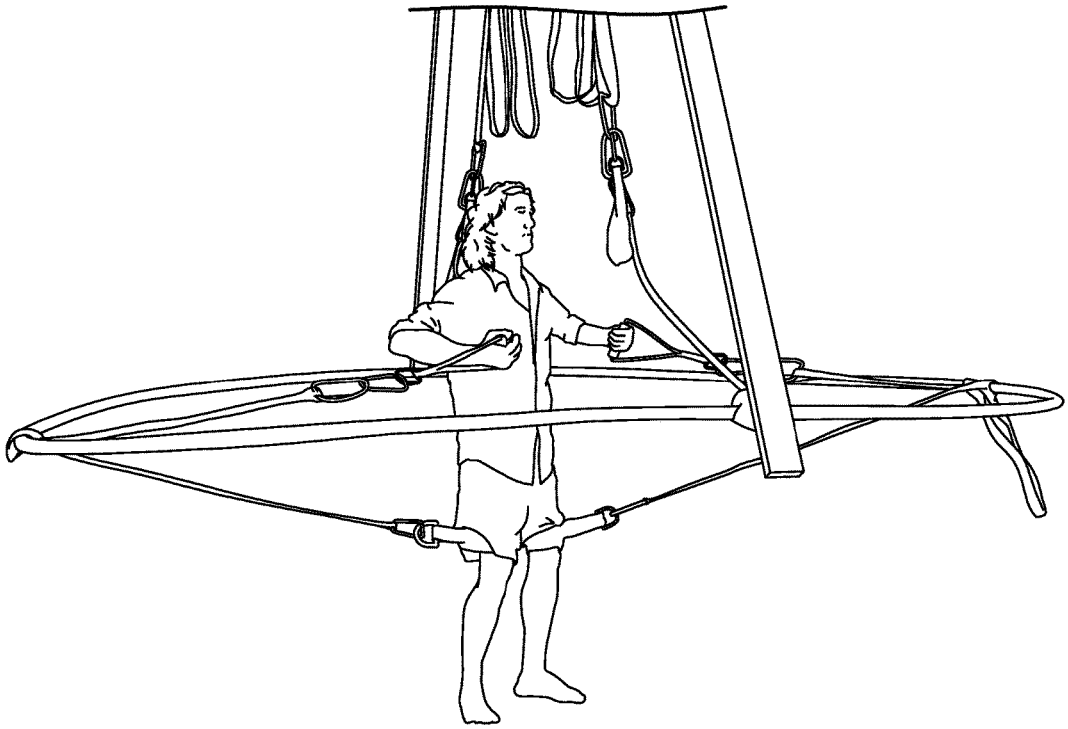
Figure 34:
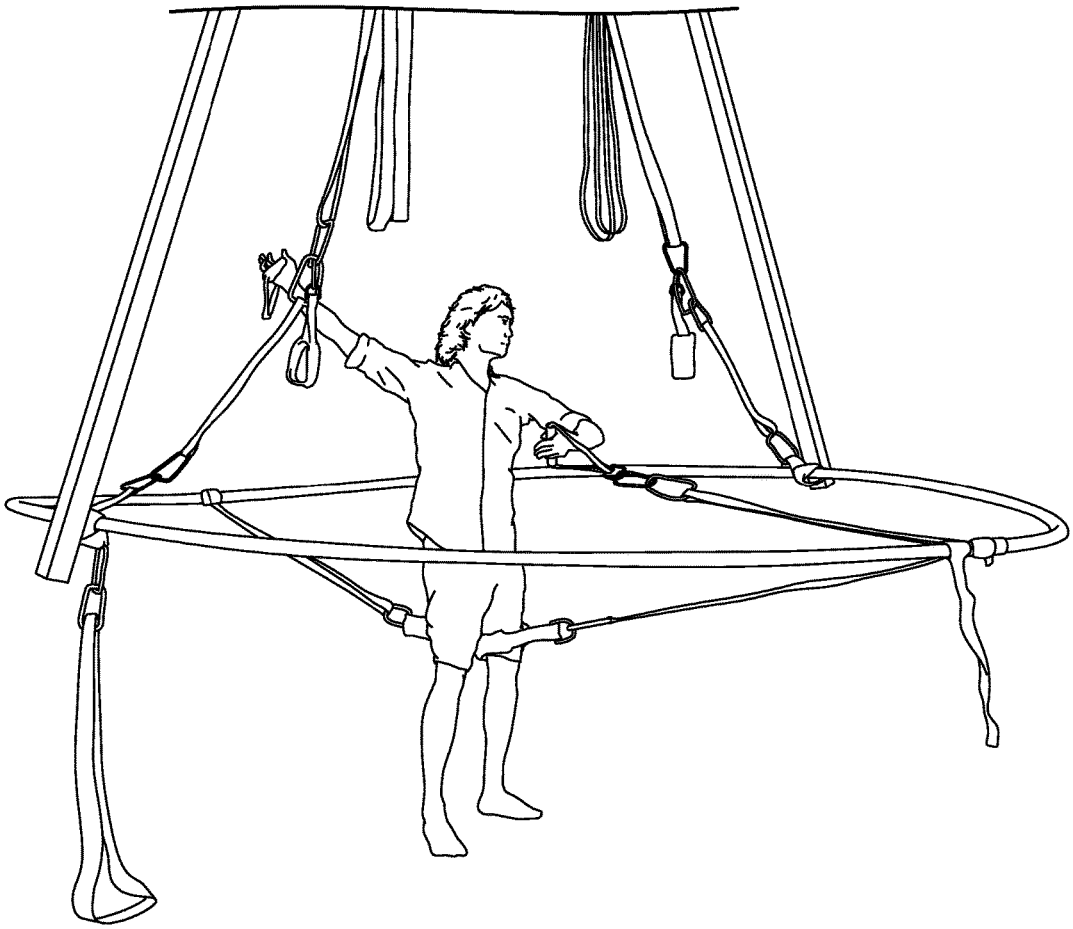

FIGS. 33 and 34 illustrate a movement variation with a setup that is similar to that shown in FIGS. 30A-30C. The user can exert force while keeping the ribcage lifted over the pelvis in order to lengthen the front of the spine while keeping the back open.

In some embodiments, Bar 2 and Bar 3 can be fixed incrementally, meaning that Bar 2 and Bar 3 can rotate through a fixed angle with respect to each other, while leaving the top bearing able to rotate freely, allowing the user to exert force out of a torsion (or rotation). Also in this configuration the connective tissue becomes actively pre-tensioned in the opposite direction; preparatory counter movement (e.g., in FIGS. 36A and 36B, the user is starting, in FIG. 36B, in a twisted configuration). The exercises where Bar 2 and Bar 3 freely rotate can be modified to rotate through a limited angle instead.

Figure 35:
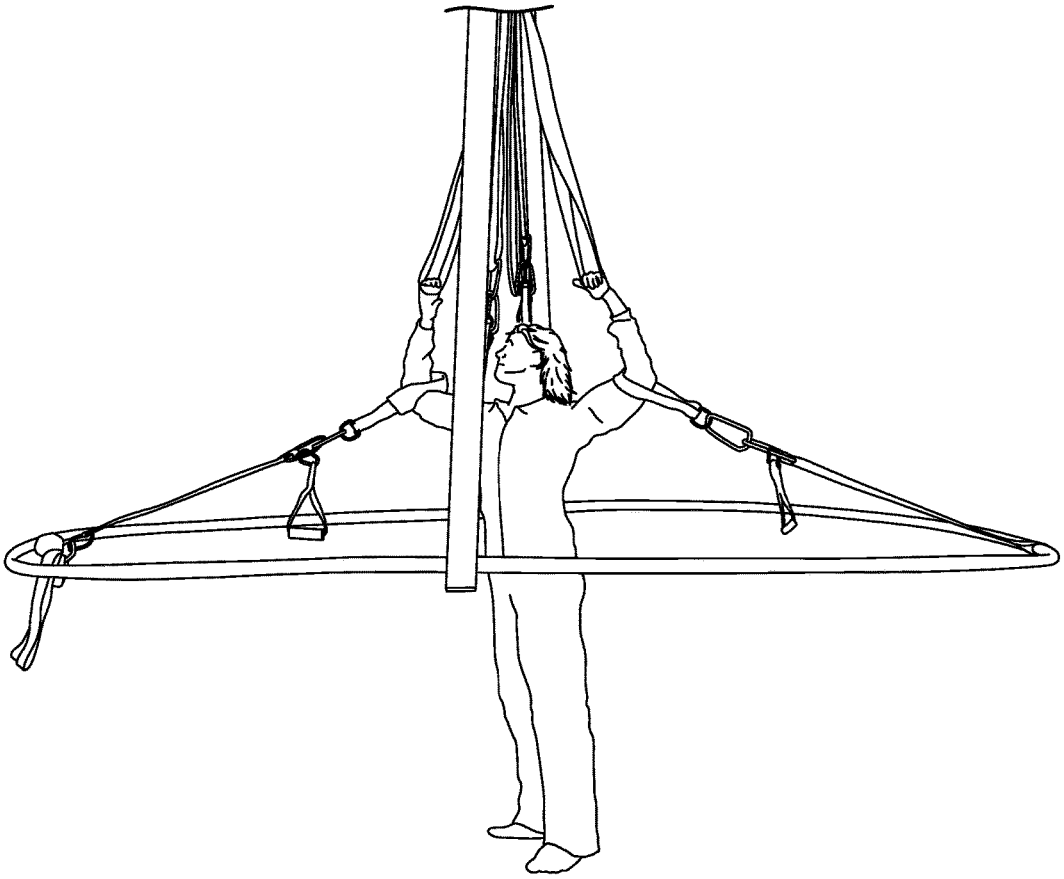
Figure 36A:
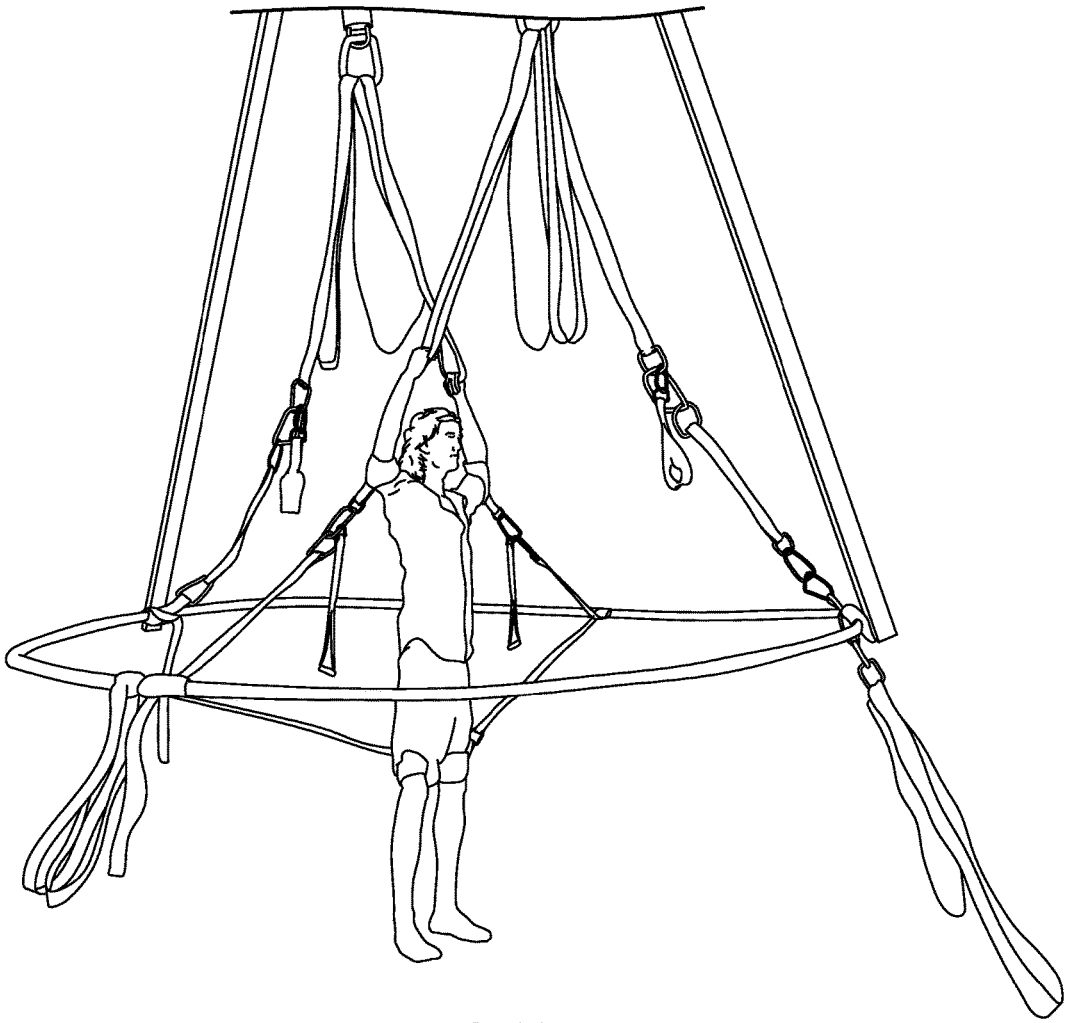
Figure 36B:
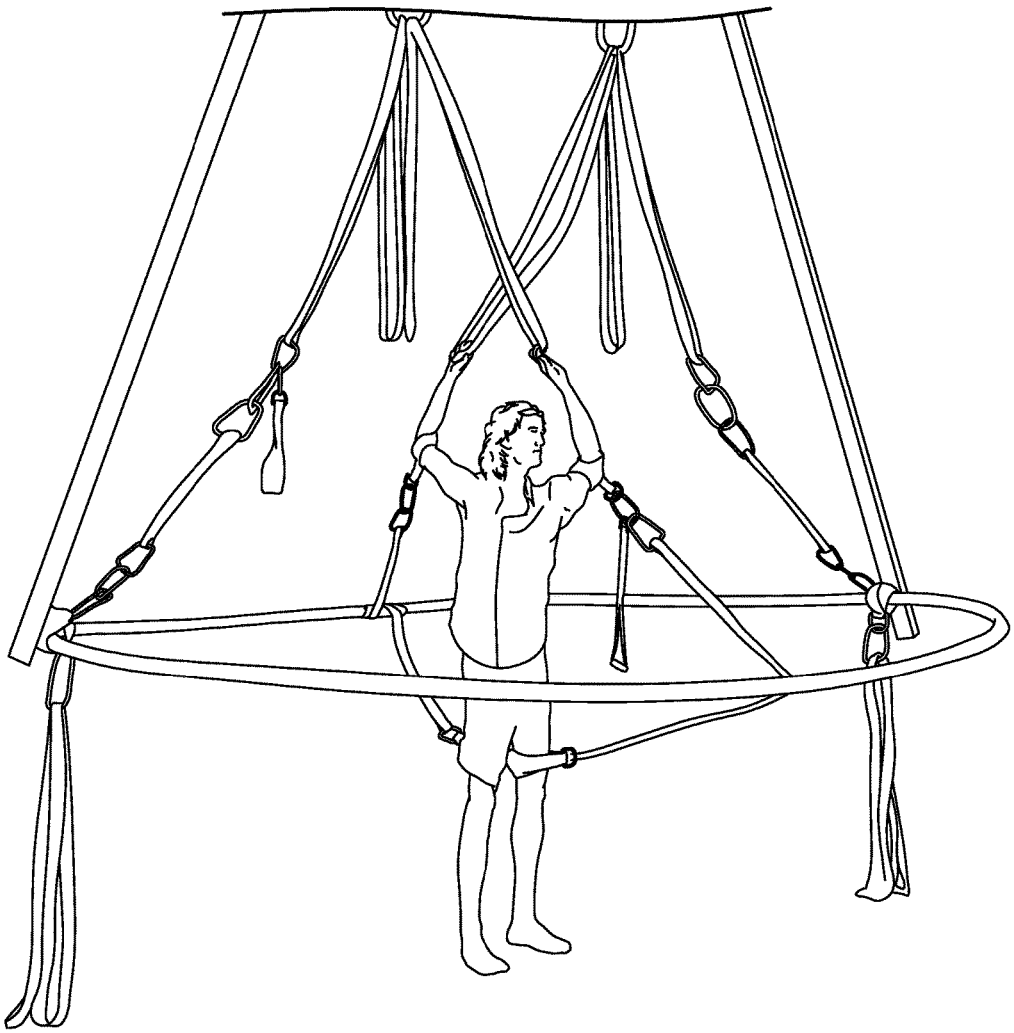
Figure 37:
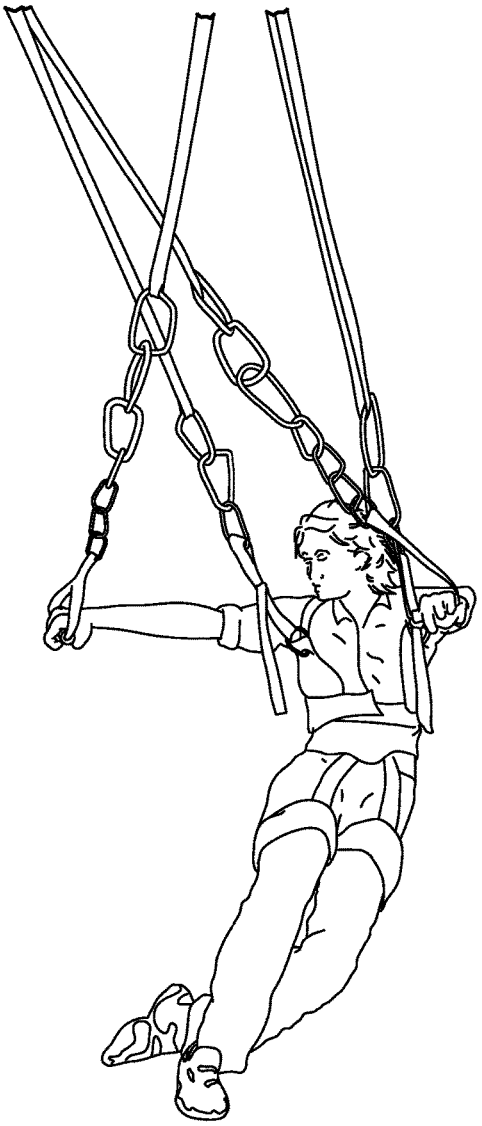
Figure 38:
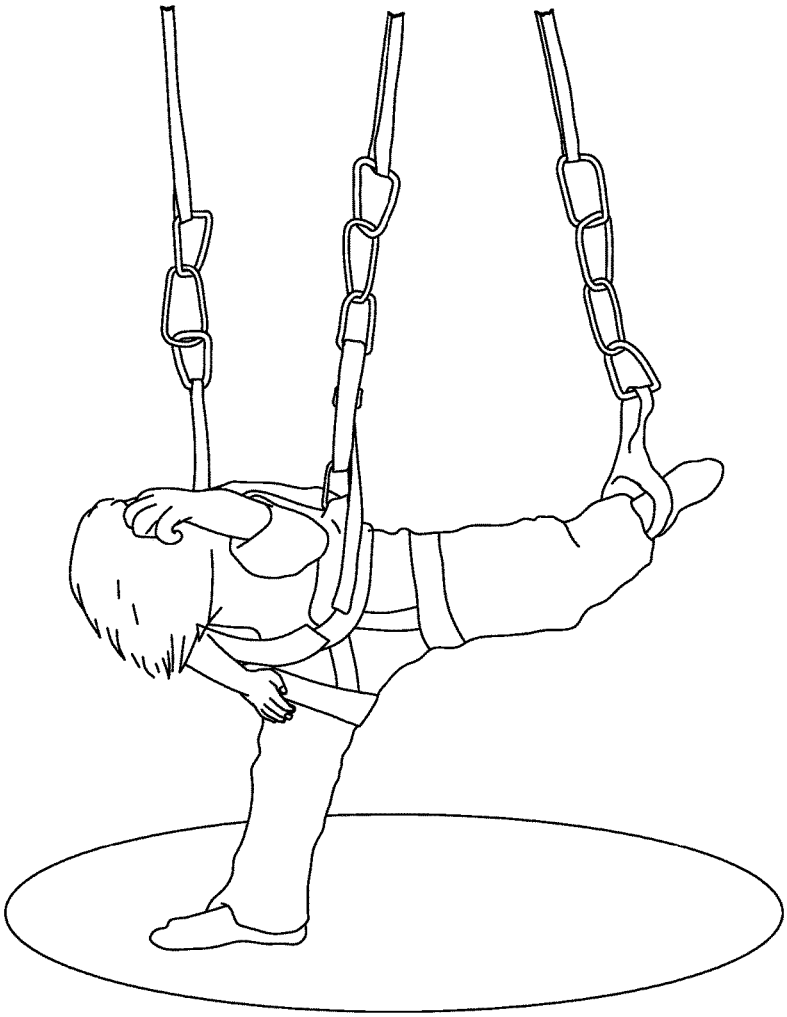
Figure 39:
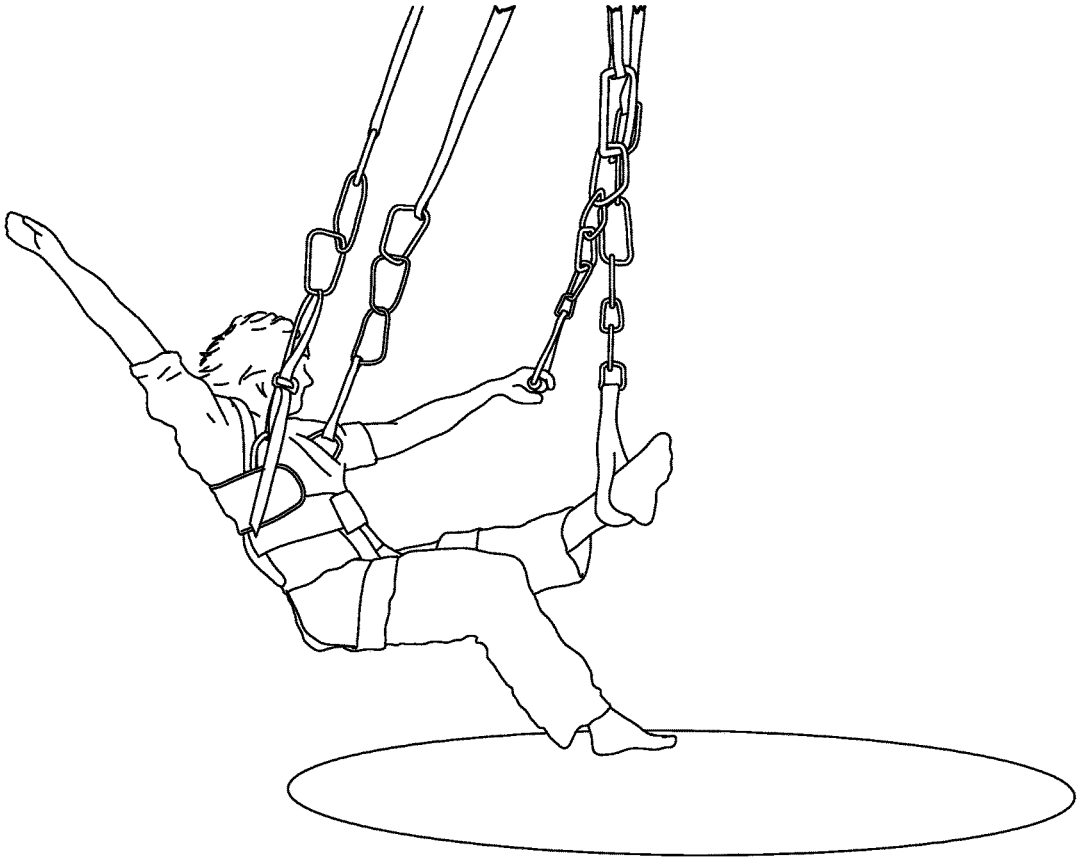
Figure 40:
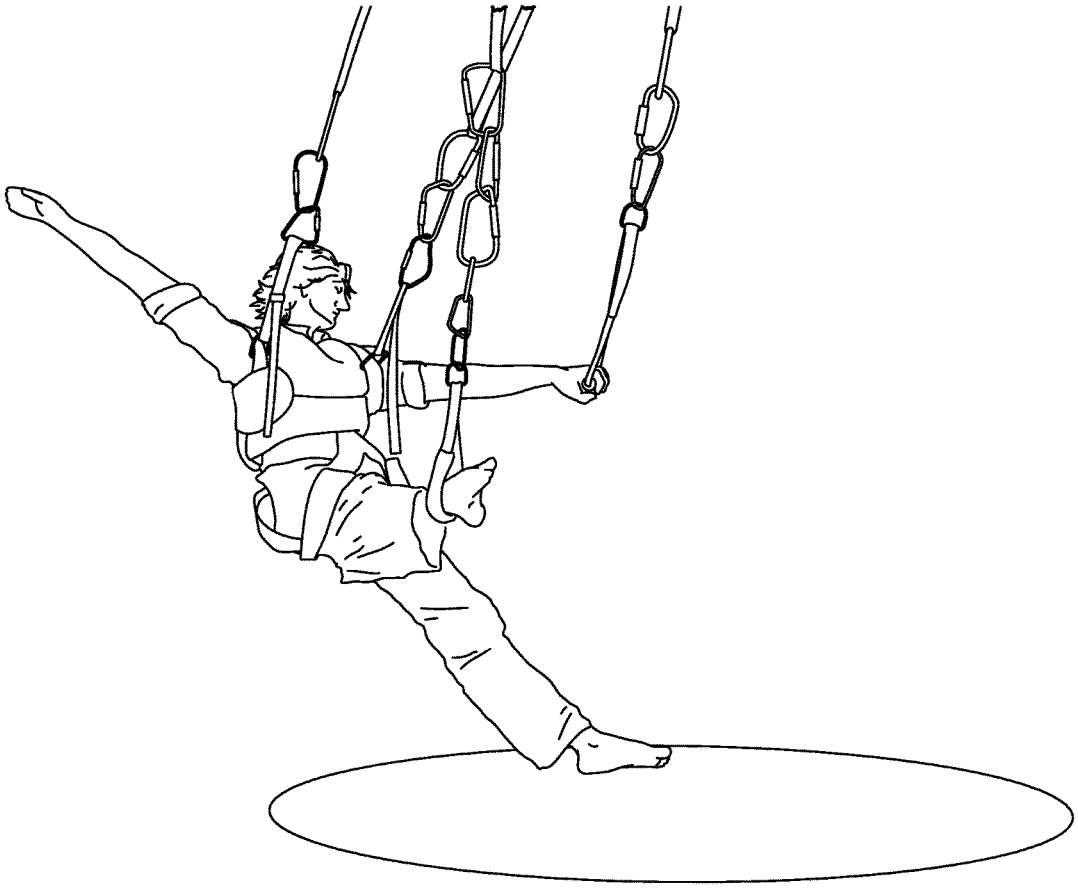

FIG. 35 illustrates a movement which uses vertical and lateral elastics to provide resistance to the arms. In this embodiment, no elastics are attached to the user's legs. The user can rotate out of an already established stable standing position using the arms and torso.

FIG. 36 illustrates an embodiment similar to that described in FIG. 35 but with lateral elastics for the legs added. The user can rotate while standing vertically such that the pelvic-girdle counter-rotates with the shoulder girdle, allowing for internal rotation of the femur.

In other embodiments, Bar 2 can be fixed with Bar 1 while Bar 3 freely rotates, as illustrated in FIGS. 37-40. In these embodiments, the arms of Bar 2 can be removed or retracted. The user can wear a harness and backrest, or just the harness (by itself). Movement can be executed barefoot or with sport shoes. A neck support can be optionally worn. Vertical elastics can be used by attaching the elastics to the lateral attachments of the harness and/or by grasping the elastics with the hands. Vertical elastics can be used to attach handles or foot loops for different movements (with or without a harness).

Although this disclosure is described in sections, and the device and methods are parsed up in a numeric devices (e.g., device 1, device 2, device 3, etc.), one of skill in the art should understand that any of the components and/or functions of these apparatus variations may be combined with or replace any other feature (unless indicated otherwise) from another of the variation (e.g., device). When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co jointly employed in the methods and articles (e.g., compositions and apparatuses including device and methods). For example, the term "comprising" will be understood to imply the inclusion of any stated elements or steps but not the exclusion of any other elements or steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An exercise system for restoring, rebuilding, and/or strengthening a person's connective tissue, the system comprising:

an anchor;

a first support structure comprising:

a pair of arms that each have a horizontally oriented portion that extends primarily in a horizontal direction and a vertically oriented portion that extends primarily in a vertical direction wherein the pair of arms each have a vertical height that is adjustable by between about 3 feet to 6 feet, one or more attachments disposed on the horizontally oriented portion of each arm, and one or more attachments disposed on the vertically oriented portion of each arm, wherein the first support structure has a width in the horizontal direction that is between about 7 feet to 11 feet;

a first rotatable bearing configured to be secured to both the anchor and the first support structure such that the first support structure can rotate freely relative to the anchor; and a plurality of elastic members configured to be removably attached to the attachments on the first support structure and held by the person or attached to the person when the person stands under the first support structure.

2. The exercise system of claim 1, further comprising:

a harness comprising:

a pair of adjustable leg loops configured to be secured to the person's thighs;

an adjustable chest strap configured to be secured around the person's chest at the level of the person's nipples;

a first pair of attachment features disposed on a first lateral side of the adjustable chest strap, wherein the first pair of attachment features are configured to be removably attached to the plurality of elastic members;

a second pair of attachment features disposed on a second lateral side of the adjustable chest strap such that the first pair of attachment features and the second pair of attachment features are configured to be located on opposite lateral sides of the person chest when the harness is worn by the person, wherein the second pair of attachment features are configured to be removably attached to the plurality of elastic members; and a frontal attachment feature located between the adjustable chest strap and the pair of adjustable leg loops; and a backrest comprising a support structure configured to provide support to the person's back.

3. The exercise system of claim 2, further comprising a neck support.

4. The exercise system of claim 2, further comprising a pair of stirrups, wherein each stirrup comprises a foot support and two elastic members that removably join the foot support to the harness, wherein the two elastic members of each stirrup comprises an inner elastic member configured to be positioned along the inner portion of the person's leg, and an outer elastic member configured to be positioned along the outer portion of the person's leg.

5. The exercise system of claim 2, further comprising a sit bones support that can be removably inserted into the harness to provide support and proprioceptive feedback to the person so that the person can position the sit bones horizontally.

6. The exercise system of claim 2, wherein when the harness is worn, the frontal attachment feature is configured to be positioned between the person's umbilicus and sternum.

7. The exercise system of claim 1, further comprising a third support structure configured to be removably attached to the pair of arms of the first support structure, the third support structure having an attachment feature configured to be removably attached to one of the plurality of the elastic members.

8. The exercise system of claim 7, wherein the third support structure has a shape selected from the group consisting of a half circle, a full circle, a triangle, a half diamond, and a full diamond.

9. The exercise system of claim 7, wherein the third support structure is configured to be removably attached to the pair of arms of the first support structure such that the third support structure lies in a plane that is transverse to a plane that encompasses the first support structure.

10. The exercise system of claim 1, wherein first support structure has an adjustable width and an adjustable height.

11. The exercise system of claim 1, wherein the vertical portion of each arm of the first support structure is removable.

12. The exercise system of claim 1, wherein the first rotatable bearing has a first configuration which is configured to allow free rotation and a second configuration which allows the rotatable bearing to be locked into a fixed position in predetermined increments.

13. The exercise system of claim 12, wherein the predetermined increment is about 30 degrees.

14. The exercise system of claim 1, wherein the pair of arms of the first support structure are removable.

15. The exercise system of claim 1, wherein the one or more attachment features are rotatable.

16. The exercise system of claim 1, wherein each pair of arms of the first support structure comprises a horizontal bar and a vertical bar having a free end, wherein the attachments are disposed proximate the free end of the vertical bar.

17. The exercise system of claim 1, wherein the first support structure has a vertical height that is adjustable between about 7 feet to 10 feet.

18. The exercise system of claim 1, further comprising a second support structure that extends in a horizontal direction, the second support structure having at least two attachment features spaced apart from each other and has a width that is at least about 35 inches, and a second rotatable bearing configured to be rotatably secured to both the first support structure and the second support structure such that the first support structure can rotate relative to the second support structure.

19. An exercise system for restoring, rebuilding, and/or strengthening a person's connective tissue, the system comprising:

an anchor;

a first support structure comprising:

a pair of arms that each have a horizontally oriented portion that extends primarily in a horizontal direction and a vertically oriented portion that extends primarily in a vertical direction wherein the pair of arms each have a vertical height that is adjustable by between about 3 feet to 6 feet, one or more attachments disposed on the horizontally oriented portion of each arm, and one or more attachments disposed on the vertically oriented portion of each arm, wherein the first support structure has a width in the horizontal direction that is between about 7 feet to 11 feet;

a second support structure that extends in the horizontal direction, the second support structure having at least two attachments spaced apart from each other;

a first rotatable bearing configured to be secured to both the anchor and the first support structure such that the first support structure can rotate freely relative to the anchor; and a second rotatable bearing configured to be secured to both the first support structure and the second support structure such that the first support structure can rotate relative to the second support structure;

a plurality of elastic members configured to be removably attached to the attachments on the first support structure and held by the person or attached to the person when the person stands under the first support structure.

* * * * *